US011371215B2

(12) United States Patent
Fukuda et al.

(10) Patent No.: US 11,371,215 B2
(45) Date of Patent: Jun. 28, 2022

(54) WORKING MACHINE

(71) Applicant: KUBOTA CORPORATION, Osaka (JP)

(72) Inventors: Yuji Fukuda, Osaka (JP); Kohei Nagao, Osaka (JP); Ryota Hamamoto, Osaka (JP); Hiroaki Nakagawa, Osaka (JP); Yoshimitsu Tanaka, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 17/397,147

(22) Filed: Aug. 9, 2021

(65) Prior Publication Data

US 2022/0049471 A1 Feb. 17, 2022

(30) Foreign Application Priority Data

Aug. 15, 2020 (JP) ..... JP2020-137168
Jun. 9, 2021 (JP) ..... JP2021-096742

(51) Int. Cl.
*E02F 9/22* (2006.01)
*E02F 9/20* (2006.01)

(52) U.S. Cl.
CPC ..... *E02F 9/2253* (2013.01); *E02F 9/2083* (2013.01); *E02F 9/225* (2013.01); *E02F 9/2285* (2013.01); *E02F 9/2292* (2013.01)

(58) Field of Classification Search
CPC ..... E02F 9/2253; E02F 9/2285; E02F 9/225; E02F 9/2203; E02F 9/2083
See application file for complete search history.

(56) References Cited

U.S. PATENT DOCUMENTS 6,374,605 B1 * 4/2002 Dvorak ..... F16D 31/02 60/452
6,666,023 B2 * 12/2003 Nagura ..... F15B 11/165 60/443
8,495,870 B2 * 7/2013 Sumiyoshi ..... E02F 9/2232 60/484
11,001,990 B2 * 5/2021 Fukuda ..... E02F 9/226
2017/0282934 A1 * 10/2017 Fukuda ..... B60W 50/085
2020/0131734 A1 * 4/2020 Maeda ..... E02F 9/2087

FOREIGN PATENT DOCUMENTS

JP 2017-179923 A 10/2017

* cited by examiner

*Primary Examiner* — Abiy Teka
(74) *Attorney, Agent, or Firm* — Greenblum & Bernstein, P.L.C.

(57) ABSTRACT

A working machine includes a first traveling fluid line through which operation fluid applied to a first pressure receiving portion when a traveling operation member is operated, a second traveling fluid line through which operation fluid applied to a second pressure receiving portion when the traveling operation member is operated, a third traveling fluid line through which operation fluid applied to a third pressure receiving portion when the traveling operation member is operated, a fourth traveling fluid line through which operation fluid applied to a fourth pressure receiving portion when the traveling operation member is operated, and a controller configured or programed to judge, first, second, third and fourth pilot pressures, whether the traveling operation member is operated in a direction corresponding to any of spin-turn, pivotal-turn and straight-traveling.

16 Claims, 7 Drawing Sheets

WORKING MACHINE

CROSS REFERENCE TO RELATED APPLICATION

This application claims the benefit of priority to Japanese Patent Application No. 2020-137168 filed on Aug. 15, 2020 and to Japanese Patent Application No. 2021-096742 filed on Jun. 9, 2021. The entire contents of this application are hereby incorporated herein by reference.

BACKGROUND OF THE INVENTION

1. Field of the Invention

The present invention relates to a working machine such as a skid steer loader, a compact track loader, or a backhoe.

2. Description of the Related Art

A technique for reducing and increasing a speed of a working machine is disclosed in Japanese Unexamined Patent Publication No. 2017-179923.

The working machine disclosed in the publication No. 2017-179923 has a prime mover including an engine, a hydraulic pump that is operated by a power of the prime mover and delivers operation fluid, a traveling hydraulic device configured to change its speed between a first speed and a second speed higher than the first speed according to a pressure of the operation fluid, an actuation valve configured to change the pressure of the operation fluid to be applied to the traveling hydraulic device, and a measuring device configured to detect the pressure of the operation fluid. When a detected pressure, which is the pressure of the operation fluid detected by the measuring device, drops from a set pressure corresponding to the second speed to be less than a predetermined pressure, the actuation valve reduces the pressure of the operation fluid applied to the traveling hydraulic device to reduce the traveling hydraulic device to the first speed.

SUMMARY OF THE INVENTION

The working device disclosed in the publication No. 2017-179923 is configured to automatically decelerate from the second speed to the first speed when the pressure of the operation fluid supplied to the traveling device in the traveling is a predetermined level or higher. Recently, there has been a demand to judge, in performing the automatic deceleration while the working machine is traveling, whether the working machine (a traveling device) performs spin-turn, pivotal-turn, or straight-traveling.

To solve the above-mentioned technical problems, the present invention intends to provide a working machine capable of easily judging whether the working machine is performing spin-turn, pivotal-turn, or straight-traveling.

In an aspect of the present invention, a working machine includes a machine body, a left traveling device provided on a left portion of the machine body, a right traveling device provided on a right portion of the machine body, a left traveling motor configured to output power to the left traveling device, a right traveling motor configured to output power to the right traveling device, a left traveling pump to supply operation fluid to the left traveling motor, the left traveling pump including a first pressure receiving portion and a second pressure receiving portion so that the operation fluid is used to apply a pressure to at least one of the first and second pressure receiving portions, a right traveling pump to supply operation fluid to the right traveling motor, the right traveling pump including a third pressure receiving portion and a fourth pressure receiving portion so that the operation fluid is used to apply a pressure to at least one of the third and fourth pressure receiving portions, a traveling operation device including a traveling operation member and configured to apply the pressure of operation fluid to at least one of the first, second, third and fourth pressure receiving portions according to operation of the traveling operation member, a first traveling fluid line connected to the first pressure receiving portion, the operation fluid having the pressure applied to the first pressure receiving portion being passed through the first traveling fluid line according to operation of the traveling operation member, a second traveling fluid line connected to the second pressure receiving portion, the operation fluid having the pressure applied to the second pressure receiving portion being passed through the second traveling fluid line according to operation of the traveling operation member, a third traveling fluid line connected to the third pressure receiving portion, the operation fluid having the pressure applied to the third pressure receiving portion being passed through the third traveling fluid line according to operation of the traveling operation member, a fourth traveling fluid line connected to the fourth pressure receiving portion, the operation fluid having the pressure applied to the fourth pressure receiving portion being passed through the fourth traveling fluid line according to operation of the traveling operation member, a first pressure detector configured to detect a first pilot pressure that is the pressure of operation fluid passed through the first traveling fluid line, a second pressure detector configured to detect a second pilot pressure that is the pressure of operation fluid passed through the second traveling fluid line, a third pressure detector configured to detect a third pilot pressure that is the pressure of operation fluid passed through the third traveling fluid line, a fourth pressure detector configured to detect a fourth pilot pressure that is the pressure of operation fluid passed through the fourth traveling fluid line, and a controller configured or programed to judge, based on the first, second, third and fourth pilot pressures, whether the traveling operation member is operated in a direction corresponding to any of spin-turn, pivotal-turn and straight-traveling.

The controller is configured or programmed to judge whether the traveling operation member is operated in the direction corresponding to either the spin-turn or the pivotal-turn or not when a first ratio between the second pilot pressure and the third pilot pressure is within a predetermined range or when a second ratio between the first pilot pressure and the fourth pilot pressure is within a predetermined ratio.

The controller is configured or programmed to judge whether the traveling operation member is operated in a direction corresponding to either the spin-turn or the pivotal-turn or not based on a first judgment value that is a larger one of the first and fourth pilot pressures and a second judgment value that is a larger one of the second and third pilot pressures.

The controller is configured or programmed to consider the traveling operation member as being operated in the direction corresponding to the spin-turn when the first judgment value is less than a first average value corresponding to an average of the second and third pilot pressures or when the second judgment value is less than a second average value corresponding to an average of the first and fourth pilot pressures, and to consider the traveling operation member as being operated in the direction corresponding to the pivotal-turn when the first judgment value is not less than the first average value or when the second judgment value is not less than the second average value.

The controller is configured or programmed: to judge whether a third ratio between the first pilot pressure and the third pilot pressure is within a predetermined range or not and whether a fourth ratio between the second pilot pressure and the fourth pilot pressure is within a predetermined range or not; to define a larger one of the second pilot pressure and the fourth pilot pressure as a first straight traveling value when the third ratio is within the predetermined range; to define a larger one of the first pilot pressure and the third pilot pressure as a second straight traveling value when the fourth ratio is within the predetermined range; to calculate a straight traveling degree based on a third average value corresponding to an average of the first and third pilot pressures and on the first straight traveling value; to calculate a straight traveling degree based on a fourth average value corresponding to an average of the second and fourth pilot pressures and on the second straight traveling value; and to judge whether the traveling operation member is operated in the direction corresponding to the straight-traveling or not based on the calculated straight traveling degree.

The controller is configured or programmed: to judge whether a first ratio between the second pilot pressure and the third pilot pressure is within a predetermined range or not and whether a second ratio between the first pilot pressure and the fourth pilot pressure is within a predetermined range or not; to define a larger one of the first pilot pressure and the fourth pilot pressure as a first judgment value when the first ratio is within the predetermined range; to define a larger one of the second pilot pressure and the third pilot pressure as a second judgment value when the second ratio is within the predetermined range; to calculate a left turning degree based on a first average value corresponding to an average of the second and third pilot pressures and on the first judgment value; to calculate a right turning degree based on a second average value corresponding to an average of the first and fourth pilot pressures and on the second judgment value; and to judge whether the traveling operation member is operated for left turning of the working machine in the direction corresponding to the spin-turn or the pivotal-turn based on the calculated left turning degree; and to judge whether the traveling operation member is operated for right turning of the working machine in the direction corresponding to the spin-turn or the pivotal-turn based on the calculated right turning degree.

The controller is configured or programmed to consider the traveling operation member as being operated in the direction corresponding to the spin-turn when either one of a first differential pressure acquired by subtracting the second pilot pressure from the first pilot pressure and a second differential pressure acquired by subtracting the fourth pilot pressure from the third pilot pressure is a positive number and the other is a negative number.

The controller is configured or programmed to consider the traveling operation member as being operated in a direction corresponding to a small turn of the working machine along a middle turning circle when the first pilot pressure is not less than a first threshold and a second differential pressure acquired by subtracting the fourth pilot pressure from the third pilot pressure is not more than a second threshold or when the third pilot pressure is not less than a third threshold and a first differential pressure acquired by subtracting the second pilot pressure from the first pilot pressure is not more than a fourth threshold.

The controller is configured or programmed to consider the traveling operation member as being operated in a direction corresponding to a small turn of the working machine along a middle turning circle when the first pilot pressure is not less than a first threshold and the third pilot pressure is not more than a fifth threshold or when the third pilot pressure is not less than a third threshold and the first pilot pressure is not more than a sixth threshold.

The controller is configured or programmed to consider the traveling operation member as being operated in a direction corresponding to a large turn of the working machine along a large turning circle that is radially larger than a middle turning circle for a small turn of the working machine when the first pilot pressure is not less than a seventh threshold and a second differential pressure acquired by subtracting the fourth pilot pressure from the third pilot pressure is not less than an eighth threshold or when the third pilot pressure is not less than a ninth threshold and a first differential pressure acquired by subtracting the second pilot pressure from the first pilot pressure is not less than a tenth threshold.

The controller is configured or programmed to consider the traveling operation member as being operated in a direction corresponding to a large turn of the working machine along a large turning circle that is radially larger than a middle turning circle for a small turn of the working machine when the first pilot pressure is not less than a seventh threshold and the third pilot pressure is not more than the seventh threshold and is not less than an eleventh threshold or when the third pilot pressure is not less than a ninth threshold and the first pilot pressure is not more than the ninth threshold and not less than a twelfth threshold.

A plurality of values are each provided as the second threshold, and a plurality of values are each provided as the fourth threshold.

A plurality of values are each provided as the eighth threshold, and a plurality of values are each provided as the tenth threshold.

The left traveling motor is rotated at a speed shiftable between a first speed and a second speed faster than the first speed, the right traveling motor is rotated at a speed shiftable between a first speed and a second speed faster than the first speed, and the controller is configured or programmed: to perform automatic deceleration to automatically reduce rotation speeds of the left and right traveling motors by shifting from the second speed to the first speed; to perform automatic speed-restoration to automatically restore the rotation speeds of the left and right traveling motors before performing the automatic deceleration by shifting from the first speed to the second speed; and to judge whether to perform the automatic deceleration and whether to perform the automatic speed-restoration based on which direction the traveling operation member is considered as being operated in.

The controller is configured or programmed: to consider the traveling operation member as being at a neutral position when the first to fourth pilot pressures are each not more than a predetermined value; and to perform the automatic speed-restoration when the automatic deceleration is performed and all the first to fourth pilot pressures are each detected as being not more than the predetermined value.

The working machine mentioned above further includes an actuation valve to control a pressure of the operation fluid supplied to the traveling operation device. The controller is configured or programmed to change control of the actuation valve based on which direction the traveling operation member is considered as being operated in.

According to the above-mentioned working machine, it is possible to easily judge whether the working machine is performing spin-turn, pivotal-turn, or straight-traveling.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

DETAILED DESCRIPTION OF THE PREFERRED EMBODIMENTS

Figure 1:
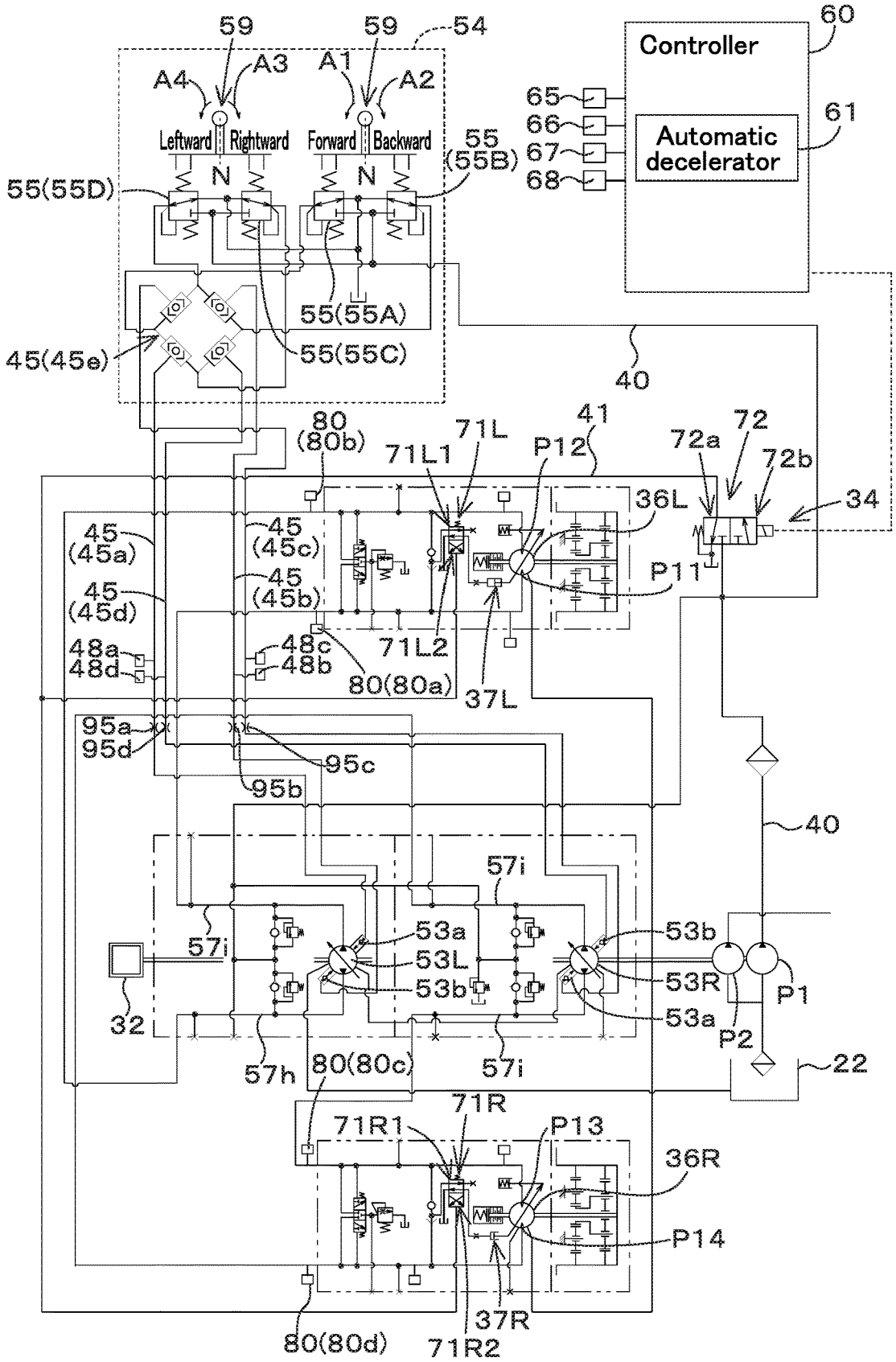
FIG. 1 is a view showing a hydraulic system (a hydraulic circuit) for a working machine.

The preferred embodiments will now be described with reference to the accompanying drawings, wherein like reference numerals designate corresponding or identical elements throughout the various drawings. The drawings are to be viewed in an orientation in which the reference numerals are viewed correctly.

A preferred embodiment of a hydraulic system for a working machine and of a working machine having the hydraulic system will be described below with reference to drawings.

Figure 7:
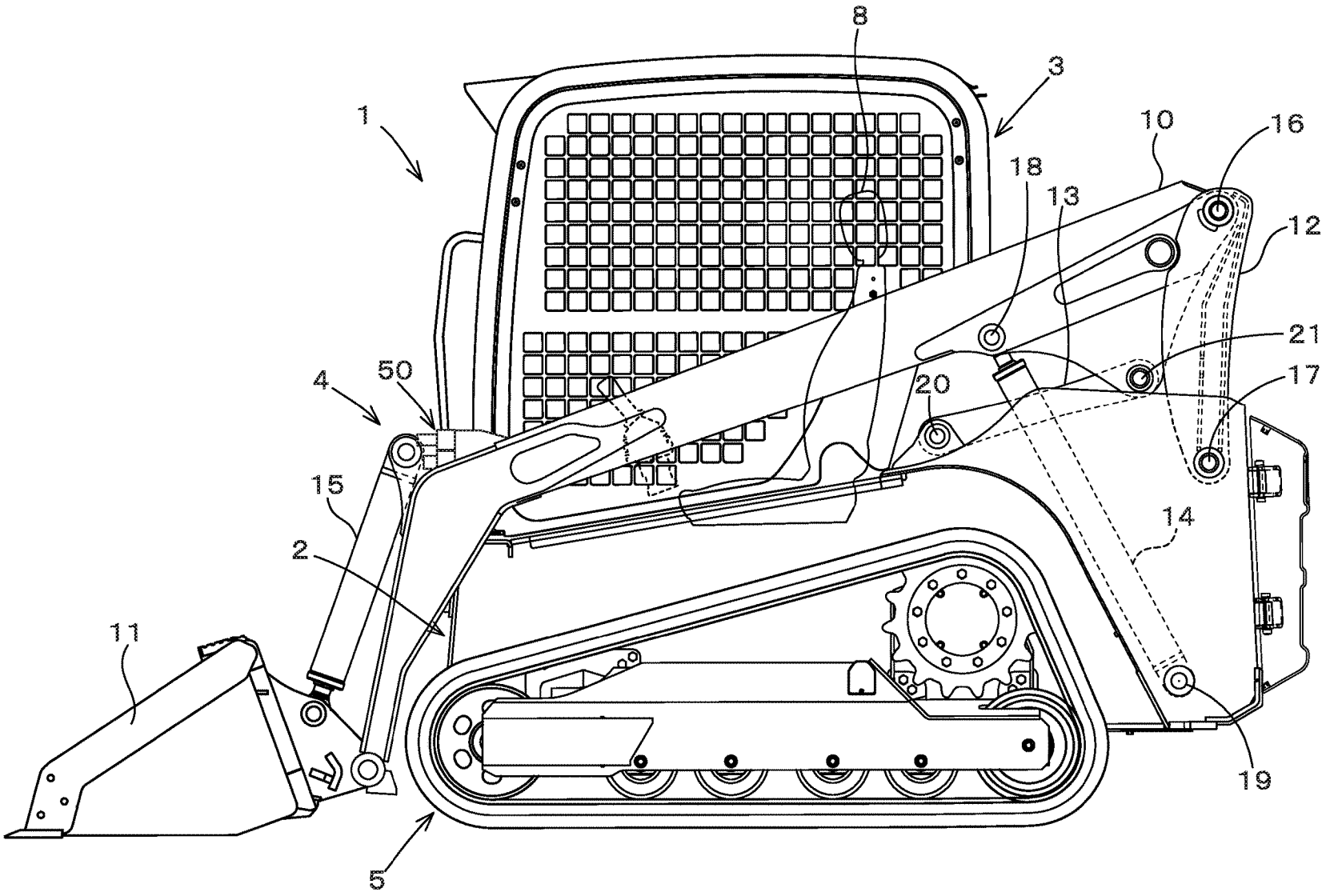
FIG. 7 is a side view showing a track loader that is an example of the working machine.

FIG. 7 is a side view of a working machine according to an embodiment of the present invention. FIG. 7 shows a compact track loader as an example of the working machine. However, the working machine according to the embodiment of the present invention is not limited to the compact track loader. The working machine may be another typed loader, such as a skid steer loader. The working machine may be any other than loaders.

As shown in FIG. 7, the working machine 1 has a machine body 2, a cabin 3, a working device 4, and a pair of traveling devices 5L and 5R. In the embodiment of the present invention, a forward direction from an operator siting on an operator's seat 8 of the working machine 1 (a left side in FIG. 7) is referred to as the front, a rearward direction from the driver (a right side in FIG. 7) is referred to as the rear, a leftward direction from the driver (a front surface side of FIG. 7) is referred to as the left, and a rightward direction from the driver (a back surface side of FIG. 7) is referred to as the right. A horizontal direction orthogonal to a fore-and-aft direction is referred to as a machine width direction. A direction from the center of the machine body 2 to the right or left is referred to as a machine outward direction. In other words, the machine outward direction is one machine width direction away from the machine body 2. A direction opposite to the machine outward direction is referred to as a machine inward direction. In other words, the machine inward direction is the other machine width direction approaching the machine body 2.

The cabin 3 is mounted on the machine body 2. The cabin 3 incorporates the driver seat 8. The working device 4 is attached to the machine body 2. A pair of traveling devices 5L and 5R are provided on outer sides of the machine body 2. A prime mover 32 is mounted on a rear inside portion of the machine body 2.

The working device 4 includes booms 10, a working tool 11, lift links 12, control links 13, boom cylinders 14, and bucket cylinders 15.

The booms 10 are arranged on right and left sides of the cabin 3 swingably up and down. The working tool 11 is a bucket, for example. The bucket 11 is arranged at tip portions (that is, front end portions) of the booms 10 movably up and down. The lift links 12 and the control links 13 support base portions (that is, rear portions) of the booms 10 so that the booms 10 can be swung up and down. The boom cylinders 14 are extended and contracted to lift and lower the booms 10. The bucket cylinders 15 are extended and contracted to swing the bucket 11.

Front portions of the right and left booms 10 are connected to each other by a deformed connecting pipe. Base portions (that is, rear portions) of the booms 10 are connected to each other by a circular connecting pipe.

The lift links 12, control links 13, and boom cylinders 14 are arranged on right and left sides of the machine body 2 to correspond to the right and left booms 10.

The lift links 12 are extended vertically from rear portions of the base potions of the booms 10. Upper portions (that is, one ends) of the lift links 12 are pivotally supported on the rear portion of the base portions of the booms 10 via respective pivot shafts (referred to as first pivot shafts) 16 rotatably around their lateral axes. Lower portions (that is, the other ends) of the lift links 12 are pivotally supported on a rearward portion of the machine body 2 via respective pivot shafts (referred to as second pivot shafts) 17 rotatably around their lateral axes. The second pivot shafts 17 are provided below the first pivot shafts 16.

Upper portions of the boom cylinders 14 are pivotally supported via respective pivot shafts (referred to as third pivot shafts) 18 rotatably around their lateral axes. The third pivot shafts 18 are provided at the base portions of the booms 10, especially, at front portions of the base portions. Lower portions of the boom cylinders 14 are pivotally supported respective pivot shafts (referred to as fourth pivot shafts) 19 rotatably around their lateral axes. The fourth pivot shafts 19 are provided closer to a lower portion of the rear portion of the machine body 2 and below the third pivot shafts 18.

The control links 13 are provided in front of the lift links 12. One ends of the control links 13 are pivotally supported via respective pivot shafts (referred to as fifth pivot shafts) 20 rotatably around their lateral axes. The fifth pivot shafts 20 are provided on the machine body 2 forward from the lift links 12. The other ends of the control links 13 are pivotally supported via respective pivot shafts 21 (referred to as sixth pivot shafts) rotatably around their lateral axes. The sixth pivot shafts 21 are provided on the booms 10 forwardly upward from the second pivot shafts 17.

By extending and contracting the boom cylinders 14, the booms 10 are swung up and down around the first pivot shafts 16 with the base portions of the booms 10 supported by the lift links 12 and the control links 13, thereby lifting and lowering the tip end portions of the booms 10. The control links 13 are swung up and down around the fifth pivot shafts 20 by the vertical swinging of the booms 10. The lift links 12 are swung back and forth around the second pivot shafts 17 by the vertical swinging of the control links 13.

An alternative working tool instead of the bucket 11 can be attached to the front portions of the booms 10. For example, the alternative working tool is an attachment (that is, an auxiliary attachment) such as a hydraulic crusher, a hydraulic breaker, an angle broom, an earth auger, a pallet fork, a sweeper, a mower, a snow blower, or the like.

A connecting member 50 is provided at the front portion of the left boom 10. The connecting member 50 is a device configured to connect a hydraulic equipment attached to the auxiliary attachment to a first piping member such as a pipe provided on the left boom 10. Specifically, the first piping member can be connected to one end of the connecting member 50, and a second piping member connected to the hydraulic equipment of the auxiliary attachment can be connected to the other end. In this manner, an operation fluid flowing in the first piping member passes through the second piping member and is supplied to the hydraulic equipment.

The bucket cylinders 15 are arranged respectively closer to the front portions of the booms 10. The bucket cylinders 15 are extended and contracted to swing the bucket 11.

Of the pair of traveling devices 5L and 5R, the traveling device 5L is provided on a left side of the machine body 2, and the traveling device 5R is provided on a right side of the machine body 2. In the embodiment, crawler typed (including semi-crawler typed) traveling devices are adopted as the pair of traveling devices 5L and 5R. Wheel-type traveling device having front wheels and rear wheels may also be adopted. For convenience of explanation, the traveling device 5L may be referred to as the left traveling device 5L, and the traveling device 5R may be referred to as the right traveling device 5R.

The prime mover 32 is an internal combustion engine such as a diesel engine, a gasoline engine, an electric motor, or the like. In the embodiment, the prime mover 32 is the diesel engine, but is not limited thereto.

Next, the hydraulic system for the working machine will be described.

As shown in FIG. 1, the hydraulic system for the working machine has a first hydraulic pump P1 and a second hydraulic pump P2. The first hydraulic pump P1 is a pump configured to be driven by power of the prime mover 32 and includes a constant displacement gear pump. The first hydraulic pump P1 is capable of delivering operation fluid stored in a tank 22. Specifically, the first hydraulic pump P1 delivers operation fluid that is mainly used for control. For convenience of explanation, the tank 22 that stores operation fluid may be referred to as an operation fluid tank. Of the operation fluid delivered from the first hydraulic pump P1, the operation fluid used for control is referred to as pilot fluid, and a pressure of the pilot fluid is referred to as a pilot pressure.

The second hydraulic pump P2 is a pump to be driven by power of the prime mover 32, and includes a constant displacement gear pump. The second hydraulic pump P2 is capable of delivering operation fluid stored in the tank 22 and, for example, supplies the operation fluid to fluid lines of a working system. For example, the second hydraulic pump P2 supplies operation fluid to control valves (that is, flow-rate control valves) that control the boom cylinders 14 for operating the booms 10, the bucket cylinders 15 for operating the bucket, and an auxiliary hydraulic actuator for operating the auxiliary hydraulic actuator.

The hydraulic system for the working machine has a pair of traveling motors 36L and 36R and a pair of traveling pumps 53L and 53R. The pair of traveling motors 36L and 36R output power to the pair of traveling devices 5L and 5R. Of the pair of traveling motors 36L and 36R, the traveling motor 36L transmits rotational power to the traveling device (referred to as a left traveling device) 5L, and the traveling motor 36R transmits rotational power to the traveling device (referred to as a right traveling device) 5R.

The pair of traveling pumps 53L and 53R are pumps to be driven by power of the prime mover 32 and are variable displacement axial pumps with respective swash plates, for example. The pair of traveling pumps 53L and 53R are driven to supply operation fluid respectively to the pair of traveling motors 36L and 36R. Of the pair of traveling pumps 53L and 53R, the traveling pump 53L supplies the operation fluid to the traveling motor 36L, and the traveling pump 53R supplies the operation fluid to the traveling motor 36R.

For convenience of explanation, the traveling pump 53L may be referred to as a left traveling pump 53L, the traveling pump 53R may be referred to as a right traveling pump 53R, the traveling motor 36L may be referred to as a left traveling motor 36L, and the traveling motor 36R may be referred to as a right traveling motor 36R.

Each of the left traveling pump 53L and the right traveling pump 53R has a pressure-receiving portion 53*a* and a pressure-receiving portion 53*b* to which a pressure (that is, a pilot pressure) of the operation fluid (that is, pilot fluid) from the first hydraulic pump P1 is applied, and angles of the swash plates are changed by the pilot pressures applied to the pressure-receiving portions 53*a* and 53*b*. By changing an angle of each of the swash plates, an output (that is, a delivery amount of operation fluid) and an operation fluid delivery direction of each of the left and right traveling pumps 53L and 53R can be changed.

The left traveling pump 53L and the left traveling motor 36L are connected by a connecting fluid line 57*h*, and operation fluid delivered by the left traveling pump 53L is supplied to the left traveling motor 36L. The right traveling pump 53R and the right traveling motor 36R are connected by a connecting fluid line 57*i*, and the operation fluid delivered by the right traveling pump 53R is supplied to the right traveling motor 36R.

The left traveling motor 36L can be rotated by operation fluid delivered from the left traveling pump 53L, and at a rotation speed (that is, number of rotations) variable according to a flow rate of the operation fluid. A swash plate switching cylinder 37L is connected to the left traveling motor 36L, so that a rotation speed (that is, number of rotations) of the left traveling motor 36L can also be changed by extending or contracting the swash plate switching cylinder 37L in either one of opposite directions. When the swashplate switching cylinder 37L is contracted, a rotation speed of the left traveling motor 36L is set to a low speed (referred to as a first speed), and when the swash plate switching cylinder 37L is extended, a rotation speed of the left traveling motor 36L is set to a high speed (referred to as a second speed). In other words, the rotation speed of the left traveling motor 36L is shiftable between the first speed that is the low speed stage and the second speed that is the high speed stage.

The right traveling motor 36R can be rotated by operation fluid delivered from the right traveling pump 53R, and at a rotation speed (that is, number of rotations) variable according to a flow rate of the operation fluid. A swash plate switching cylinder 37R is connected to the right traveling motor 36R, so that a rotation speed (that is, number of rotations) of the right traveling motor 36R can also be changed by extending or contracting the swashplate switching cylinder 37R in either one of opposite directions. When the swash plate switching cylinder 37R is contracted, a rotation speed of the right traveling motor 36R is set to a low speed (referred to as a first speed), and when the swash plate switching cylinder 37R is extended, a rotation speed of the right traveling motor 36R is set to a high speed (referred to as a second speed). In other words, the rotation speed of the right traveling motor 36L is shiftable between the first speed that is the low speed stage and the second speed that is the high speed stage.

As shown in FIG. 1, the hydraulic system for the working device has a traveling switching valve 34. The traveling switching valve 34 is shiftable between a first state where rotation speeds (that is, numbers of rotations) of the traveling motors (that is, the lefts traveling motor 36L and the right traveling motor 36R) are each set at the first speed and a second state where rotation speeds of the traveling motors are each set at the second speed. The travel switching valve 34 includes first switching valves 71L and 71R and a second switching valve 72.

The first switching valve 71L is connected via a fluid line to the swashplate switching cylinder 37L of the left traveling motor 36L, and is configured as a two-position switching valve shiftable between a first position 71L1 and a second position 71L2. The first switching valve 71L, when set at the first position 71L1, contracts the swash plate switching cylinder 37L, and when set at the second position 71L2, extends the swashplate switching cylinder 37L.

The first switching valve 71R is connected via a fluid line to the swash plate switching cylinder 37R of the right traveling motor 36R, and is configured as a two-position switching valve shiftable between a first position 71R1 and a second position 71R2. The first switching valve 71R, when set at the first position 71L1, contracts the swash plate switching cylinder 37R, and when set at the second position 71R2, extends the swash plate switching cylinder 37R.

The second switching valve 72 is a solenoid valve that switches the first switching valve 71L and the first switching valve 71R, and is configured as a two-position switching valve shiftable based on magnetization between a first position 72*a* and a second position 72*b*. The second switching valve 72, the first switching valve 71L and the first switching valve 71R are connected by a fluid line 41. The second switching valve 72, when set at the first position 72*a*, switches the first switching valve 71L and the first switching valve 71R to the first positions 71L1 and 71R1, and when set at the second position 72*b*, switches the first switching valve 71L and the first switching valve 71R to the second positions 71L2 and 71R2.

The traveling switching valve 34 is set in the first state to shift each of rotation speeds of the traveling motors (that is, the traveling motor 36L and the traveling motor 36R) to the first speed when the second switching valve 72 is set at the first position 72*a*, the first switching valve 71L is set at the first position 71L1, and the first switching valve 71R is set at the first position 71R1. The traveling switching valve 34 is set in the second state to shift each of rotation speeds of the traveling motors (that is, the traveling motor 36L and the traveling motor 36R) to the second speed when the second switching valve 72 is set at the second position 72*b*, the first switching valve 71L is set at the second position 71L2, and the first switching valve 71R is set at the second position 71R2.

Accordingly, due to the traveling switching valve 34, the traveling motors (that is, the left and right traveling motors 36L and 36R) are set at a speed stage shiftable between the first speed that is the low speed stage and the second speed that is the high speed stage.

An operation device (that is, a traveling operating device) 54 is configured to apply operation fluid to the pressure-receiving portions 53*a* and 53*b* of the traveling pumps (that is, the left traveling pump 53L and the right traveling pump 53R) when a traveling operation member 59 is operated, and is capable of changing the angles of swash plates (referred to as swash plate angles) of the traveling pumps 53L and 53R. The operation device 54 includes the traveling operation member 59 and a plurality of operation valves 55.

The traveling operation member 59 is an operation lever that is supported on the operation valves 55 and swingable in opposite left-and-right directions (that is, the opposite machine width directions) or the opposite fore-and-aft directions. The traveling operation member 59 is operable to the right and to the left from a neutral position N, and to the front and to the rear from the neutral position N. In other words, the traveling operation member 59 is swingable in at least four directions from the neutral position N. For convenience of explanation, the forward and backward directions, that is, opposite fore-and-aft directions, may be referred to as first directions. The rightward and leftward directions, that is, opposite lateral directions (that is, opposite machine width directions), are may be referred to as second directions.

The plurality of operation valves 55 are operated by the common, i.e., single, traveling operation member 59. The plurality of operation valves 55 are actuated according to swinging of the traveling operation member 59. A delivery fluid line 40 is connected to the plurality of operation valves 55, so that operation fluid (that is, pilot fluid) from the first hydraulic pump P1 can be supplied to the operation valves 55 through the delivery fluid line 40. The plurality of operation valves 55 include an operation valve 55A, an operation valve 55B, an operation valve 55C, and an operation valve 551).

When the traveling operation member 59 is swung forward (that is, in one of the opposite fore-and-aft directions (or in one of the opposite first directions)), i.e., when a forward operation is performed, the operation valve 55A outputs operation fluid having a pressure variable according to an operation amount (operation) of the forward operation. When the traveling operation member 59 is swung backward (that is, in the other of the opposite fore-and-aft directions (or in the other of the opposite first directions)), i.e., when a backward operation is performed, the operation valve 55B outputs operation fluid having a pressure variable according to an operation amount (operation) of the backward operation. When the traveling operation member 59 is swung rightward (that is, in one of the opposite lateral directions (or in one of the opposite second directions)), i.e., when a rightward operation is performed, the operation valve 55C outputs operation fluid having a pressure variable according to an operation amount (operation) of the rightward operation. When the traveling operation member 59 is swung leftward (that is, in the other of the opposite lateral directions (or in the other of the opposite second directions)), i.e., when a leftward operation is performed, the operation valve 55D outputs operation fluid having a pressure variable according to an operation amount (operation) of the leftward operation.

The plurality of operation valves 55 are connected to the traveling pumps (the traveling pump 53L and the traveling pump 53R) by the traveling fluid line 45. In other words, the traveling pumps (the traveling pump 53L and the traveling pump 53R) are hydraulic equipment that are configured to be operated by operation fluid output from the operation valves 55 (that is, the operation valve 55A, operation valve 55B, operation valve 55C, and operation valve 55D).

The traveling fluid line 45 includes a first traveling fluid line 45*a*, a second traveling fluid line 45*b*, a third traveling fluid line 45*c*, a fourth traveling fluid line 45*d*, and a fifth traveling fluid line 45*e*. The first traveling fluid line 45*a* is a fluid line connected to the pressure-receiving portion (referred to as a first pressure-receiving portion) 53*a* of the left traveling pump 53L, and is a fluid line through which operation fluid to be applied to the pressure-receiving portion (the first pressure-receiving portion) 53*a* flows when the traveling operation member 59 is operated. The second traveling fluid line 45*b* is a fluid line connected to the pressure-receiving portion (referred to as a second pressure-receiving portion) 53*b* of the left traveling pump 53L, and is a fluid line through which operation fluid to be applied to the pressure-receiving portion (the second pressure-receiving portion) 53*b* flows when the traveling operation member 59 is operated. The third traveling fluid line 45*c* is a fluid line connected to the pressure-receiving portion (referred to as a third pressure-receiving portion) 53*a* of the right traveling pump 53R, and is a fluid line through which operation fluid to be applied to the pressure-receiving portion (the third pressure-receiving portion) 53*a* flows when the traveling operation member 59 is operated. The fourth traveling fluid line 45*d* is a fluid line connected to the pressure-receiving portion (referred to as a fourth pressure-receiving portion) 53*b* of the right traveling pump 53R, and is a fluid line through which operation fluid to be applied to the pressure-receiving portion (the fourth pressure-receiving portion) 53*b* flows when the traveling operation member 59 is operated. The fifth traveling fluid line 45*e* is a fluid line that connects the operation valves 55 to the first traveling fluid line 45*a*, the second traveling fluid line 45*b*, the third traveling fluid line 45*c*, and the fourth traveling fluid line 45*d*.

Figure 2:
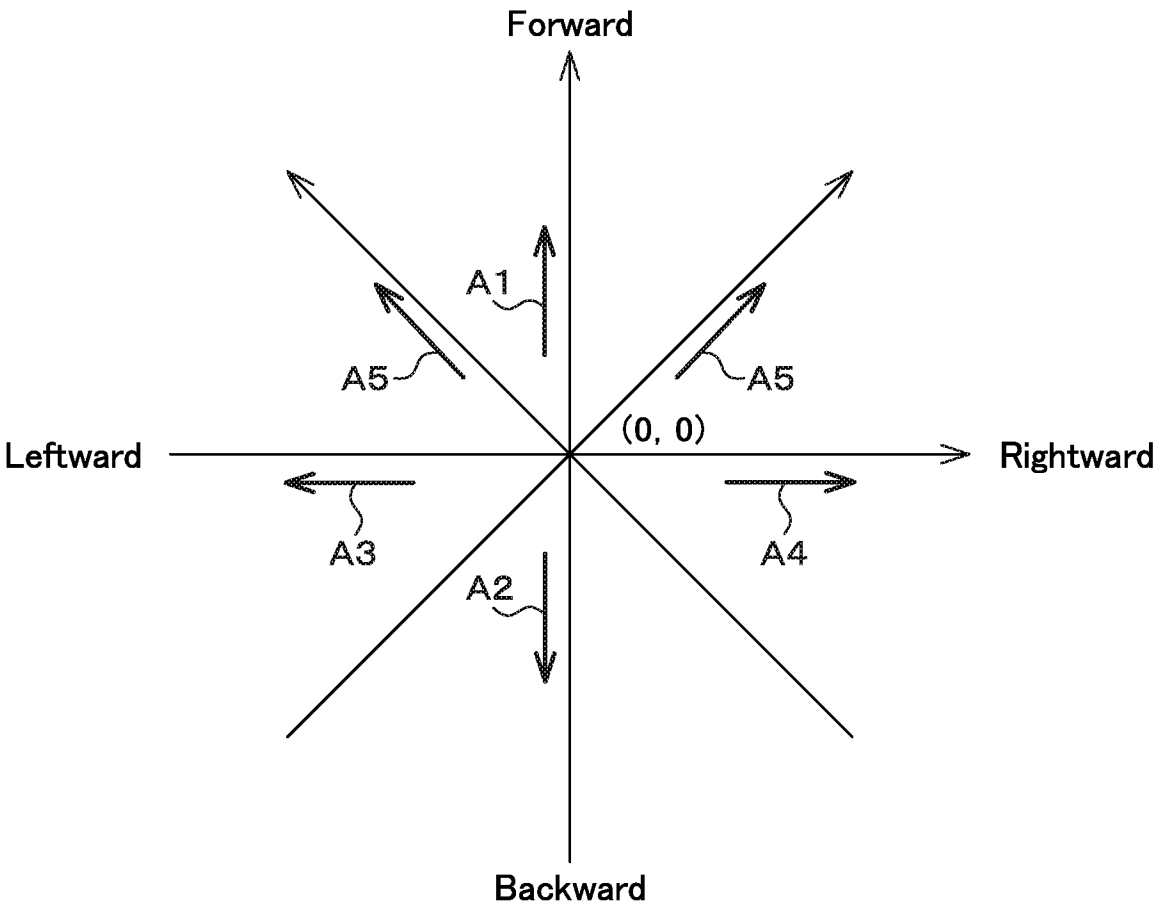
FIG. 2 is a view showing an operational direction of a traveling operation member.

When the traveling operation member 59 is swung forward (in a direction indicated by an arrowed line A1 in FIGS. 1 and 2), the operation valve 55A is operated to output a pilot pressure therefrom. This pilot pressure is applied to the pressure-receiving portion 53*a* of the left traveling pump 53L via the first traveling fluid line 45*a* and to the pressure-receiving portion 53*a* of the right traveling pump 53R via the third traveling fluid line 45*c*. In this manner, the swash plate angles of the left traveling pump 53L and the right traveling pump 53R are changed to rotate the left traveling motor 36L and the right traveling motor 36R forwardly (referred to as forward rotation), whereby the working machine 1 travels straight forward.

When the traveling operation member 59 is swung backward (in a direction indicated by an arrowed line A2 in FIGS. 1 and 2), the operation valve 55B is operated to output a pilot pressure therefrom. This pilot pressure is applied to the pressure-receiving portion 53*b* of the left traveling pump 53L via the second traveling fluid line 45*b* and to the pressure-receiving portion 53*b* of the right traveling pump 53R via the fourth traveling fluid line 45*d*. In this manner, the swash plate angles of the left traveling pump 53L and the right traveling pump 53R are changed to rotate the left traveling motor 36L and the right traveling motor 36R reversely (referred to as backward rotation), whereby the working machine 1 travels straight backward.

When the traveling control member 59 is swung to the right (in a direction indicated by an arrowed line A3 in FIGS. 1 and 2), the control valve 55C is operated to output a pilot pressure therefrom. This pilot pressure is applied to the pressure-receiving portion 53*a* of the left traveling pump 53L via the first traveling fluid line 45*a*, and to the pressure-receiving portion 53*b* of the right traveling pump 53R via the fourth traveling fluid line 45*d*. In this manner, the swash plate angles of the left traveling pump 53L and the right traveling pump 53R are changed to rotate the left traveling motor 36L forwardly, and to rotate the right traveling motor 36R reversely, whereby the working machine 1 spins to turn (spin-turns) rightward.

When the traveling control member 59 is swung to the left (in a direction indicated by an arrowed line A4 in FIGS. 1 and 2), the control valve 55D is operated to output a pilot pressure therefrom. This pilot pressure is applied to the pressure-receiving portion 53*a* of the right traveling pump 53R via the third traveling fluid line 45*c*, and to the pressure-receiving portion 53*b* of the left traveling pump 53L via the second traveling fluid line 45*b*. In this manner, the swash plate angles of the left traveling pump 53L and the right traveling pump 53R are changed to rotate the left traveling motor 36L reversely, and to rotate the right traveling motor 36R forwardly, whereby the working machine 1 spins to turn (spin-turns) leftward.

When the traveling operation member 59 is swung in an oblique direction (in a direction indicated by an arrowed line A5 in FIG. 2), rotation directions and rotation speeds of the left traveling motor 36L and the right traveling motor 36R are determined by a differential pressure between the pilot pressures applied to the pressure receiving portion 53*a* and the pressure receiving portion 53*b*, so that the working machine 1 pivots to turn rightward or leftward while traveling forward or backward.

That is, when the traveling operation member 59 is swung in a forwardly leftward oblique direction, the working machine 1 turns to the left while traveling forward at a speed corresponding to the swing angle of the traveling operation member 59. When the traveling operation member 59 is swung in a forwardly rightward oblique direction, the working machine 1 turns to the right while traveling forward at a speed corresponding to the swing angle of the traveling operation member 59. When the traveling operation member 59 is swung in a backwardly leftward oblique direction, the working machine 1 turns to the left while traveling backward at a speed corresponding to the swing angle of the traveling operation member 59. When the traveling operation member 59 is swung in a backwardly rightward oblique direction, the working machine 1 turns to the right while traveling backward at a speed corresponding to the swing angle of the traveling operation member 59.

As shown in FIG. 1, a plurality of pressure detectors 80 are connected to the circulation fluid lines 57*h* and 57*i* The plurality of pressure detectors 80 includes a first pressure detector 80*a*, a second pressure detector 80*b*, a third pressure detector 80*c*, and a fourth pressure detector 80*d*. The first pressure detector 80*a* is provided on a portion of the circulation fluid line 57*h* connected to a first port P11 of the left traveling motor 36L, and detects a first traveling pressure LF(t) that is a pressure in the portion of the circulation fluid line 57*h* connected to the first port P11. The second pressure detector 80*b* is provided on another portion of the circulation fluid line 57*h* connected to a second port P12 of the left traveling motor 36L, and detects a second traveling pressure LB(t) that is a pressure in the portion of the circulation fluid line 57*h* connected to the second port P12. The third pressure detector 80*c* is provided on a portion of the circulation fluid line 57*i* connected to a third port P13 of the right traveling motor 36R, and detects a third traveling pressure RF(t) that is a pressure in the portion of the circulation fluid line 57*i* connected to the third port P13. The fourth pressure sensing device 80*d* is provided on another portion of the circulation fluid line 57*i* connected to a fourth port P14 of the right traveling motor 36R, and detects a fourth traveling pressure RB(t) that is a pressure in the portion of the circulation fluid line 57*i* connected to the fourth port P14.

As shown in FIG. 1, the working machine 1 has a controller 60. The controller 60 performs various controls of the working machine 1 and includes a semiconductor such as a CPU or an MPU, an electrical and electronic circuit, or/and the like. An accelerator 65, a mode switch 66, a speed changer switch 67, and a plurality of rotation detectors 68 are electrically connected to the controller 60.

The mode switch 66 is a switch configured to selectively enable or disable automatic deceleration. For example, the mode switch 66 is a switch capable of being switched ON and OFF, so that the mode switch 66, when switched ON, enables the automatic deceleration operation, and when switched OFF, disables the automatic deceleration operation.

The speed changer switch 67 is provided in the vicinity of the driver seat 8 and can be operated by a driver (an operator). The speed changer switch 67 is manually operable to selectively set the rotation speed stage of the traveling motors 36L and 36R (that is, the left traveling motor 36L and right traveling motor 36R) to either the first speed or the second speed. For example, the speed changer switch 67 is a seesaw switch shiftable between a first speed position and a second speed position, thereby selectively instructing either an accelerating operation to increase rotation speeds of the traveling motors 36L and 36R by shifting their speed stage from the first speed to the second speed or a decelerating operation to reduce rotation speeds of the traveling motors 36L and 36R by shifting their speed stage from the second speed to the first speed.

The rotation detectors 68 include sensors or the like configured to detect the rotation speed and are capable of detecting the prime mover rotation speed that is the rotation speed of the prime mover 32.

The controller 60 includes an automatic decelerator 61. The automatic decelerator 61 includes an electrical and electronic circuit or the like installed in the controller 60, a computer program stored in the controller 60, and/or the like.

The automatic decelerator 61 executes an automatic deceleration control when the automatic deceleration is enabled, and does not execute the automatic deceleration control when the automatic deceleration is disabled.

In the automatic deceleration control, in a state where the traveling motors (that is, the left and right traveling motors 36L and 36R) are rotated at the second speed, the rotation speeds of the traveling motors (that is, the left and right traveling motors 36L and 36R) are automatically reduced by shifting the speed stage from the second speed to the first speed when a predetermined condition (referred to as an automatic deceleration condition) is satisfied. In the automatic deceleration control, when the automatic deceleration condition is satisfied at least in the state where the traveling motors (that is, the left and right traveling motors 36L and 36R) are rotated at the second speed, the controller 60 demagnetizes a solenoid of the second switching valve 72 to switch the second switching valve 72 from the second position 72*b* to the first position 72*a* so as to shift the speed stage from the second speed to the first speed, thereby reducing the rotation speeds of the traveling motor (that is, the left traveling motor 36L and the right traveling motor 36R). That is, in the automatic deceleration control, the controller 60 decelerates both the left traveling motor 36L and the right traveling motor 36R by shifting from the second speed to the first speed when the automatic deceleration is performed.

When a return condition is satisfied after the automatic deceleration is performed, the automatic decelerator 61 magnetizes a solenoid of the second switching valve 72 to switch the second switching valve 72 from the first position 72*a* to the second position 72*b* so as to shift the speed stage from the first speed to the second speed, thereby accelerating the traveling motors (that is, the left and right traveling motors 36L and 36R), that is, restoring the preceding speed stage of the traveling motors, i.e., performing returning from the automatic deceleration to switch the speed stage of the traveling motors from the first speed to the second speed.

That is, the controller 60 accelerates both the left traveling motor 36L and the right traveling motor 36R by shifting the speed stage from the first speed to the second speed when returning from the first speed to the second speed.

When the automatic deceleration is disabled, the controller 60 performs a manual switching control to switch the speed stage of the traveling motors (that is, the left and right traveling motors 36L and 36R) to either the first speed or the second speed according to an operation of the speed changer switch 67. In the manual switching control, when the speed changer switch 67 is switched to the first speed position, the solenoid of the second switching valve 72 is demagnetized to set the speed stage of the traveling motors (that is, the left and right traveling motors 36L and 36R) to the first speed. In the manual switching control, when the speed changer switch 67 is switched to the second speed position, the speed stage of the traveling motors (that is, the left and right traveling motors 36L and 36R) is set to the second speed by demagnetizing the solenoid of the second switching valve 72.

The hydraulic system for the working machine is capable of judging a traveling status of the working machine 1, i.e., whether the working machine 1 (machine body 2) is in the spin-turn, the pivotal-turn, or the straight-traveling, based on the pressures of operation fluids acting on respective fluid lines of the traveling fluid line 45, that is, the first traveling fluid line 45*a*, the second traveling fluid line 45*b*, the third traveling fluid line 45*c*, and the fourth traveling fluid line 45*d*.

The judgment of the traveling state will be described below.

As shown in FIG. 1, a first pressure detector 48*a* is connected to the first traveling fluid line 45*a* so that the first pressure detector 48*a* is capable of detecting a first pilot pressure lf(t) that is a pressure of the operation fluid in the first traveling fluid line 45*a*. A second pressure detector 48*b* is connected to the second traveling fluid line 45*b* so that the second pressure detector 48*b* is capable of detecting a second pilot pressure lb(t) that is a pressure of the operation fluid in the second traveling fluid line 45*b*. A third pressure detector 48*c* is connected to the third traveling fluid line 45*c* so that the third pressure detector 48*c* is capable of detecting a third pilot pressure rf(t) that is a pressure of the operation fluid in the third traveling fluid line 45*c*. A fourth pressure detector 48*d* is connected to the fourth traveling fluid line 45*d* so that the fourth pressure detector 48*d* is capable of detecting a fourth pilot pressure rb(t) that is a pressure of the operation fluid in the fourth traveling fluid line 45*d*.

The first pressure detector 48*a*, the second pressure detector 48*b*, the third pressure detector 48*c*, and the fourth pressure detector 48*d* are connected to the controller 60.

In the traveling fluid line 45, throttle portions 95*a*, 95*b*, 95*c*, and 95*d* are provided downstream of the first pressure detector 48*a*, the second pressure detector 48*b*, the third pressure detector 48*c*, and the fourth pressure detector 48*d*, respectively. Specifically, the throttle portion 95*a* is provided on a portion of the first traveling fluid line 45*a* downstream of the first pressure detector 48*a* (closer to the corresponding traveling pump than the first pressure detector 48*a*), and the throttle portion 95*b* is provided on a portion of the second traveling fluid line 45*b* downstream of the second pressure detector 48*b* (closer to the corresponding traveling pump than the second pressure detector 48*b*). The throttle portion 95*c* is provided on a portion of the third traveling fluid line 45*c* downstream of the third pressure detector 48*c* (closer to the corresponding traveling pump than the third pressure detector 48*c*), and the throttle portion 95*d* is provided on a portion of the fourth traveling fluid line 45*d* downstream of the fourth pressure detector 48*d* (closer to the corresponding traveling pump than the fourth pressure detector 48*d*). In other words, the first pressure detector 48*a*, the second pressure detector 48*b*, the third pressure detector 48*c*, and the fourth pressure detector 48*d* are provided upstream of the throttle portions 95*a*, 95*b*, 95*c*, and 95*d*, respectively (closer to the respective operation valves 55 than the throttle portions 95*a*, 95*b*, 95*c* and 95*d*). Accordingly, the pilot pressures output from the operating device 54 can be accurately detected by the first pressure detector 48*a*, the second pressure detector 48*b*, the third pressure detector 48*c*, and the fourth pressure detector 48*d*.

Based on the first pilot pressure lf(t) detected by the first pressure detector 48*a*, the second pilot pressure lb(t) detected by the second traveling fluid line 45*b*, the third pilot pressure rf(t) detected by the third traveling fluid line 45*c*, and the fourth pilot pressure rb(t) detected by the fourth traveling fluid line 45*d*, the controller 60 is capable of judging whether the operation member 59 is operated for spin-turn or pivotal-turn. The sign "(t)" indicated by each of element names "the first pilot pressure lf(t), second pilot pressure lb(t), third pilot pressure rf(t), and fourth pilot pressure rb(t)" represents a unit time (predetermined time), and the first pilot pressure lf(t), second pilot pressure lb(t), third pilot pressure rf(t), and fourth pilot pressure rb(t) represent pressures of the hydraulic fluid at the certain time.

When a first ratio of the third pilot pressure rf(t) to the second pilot pressure lb(t) is within a predetermined range, or when a second ratio of the first pilot pressure lf(t) to the fourth pilot pressure rb(t) is within the predetermined range, the controller 60 a considers a presently performed operation as corresponding to the spin-turn and the pivotal-turn. Specifically, the controller 60 considers the presently performed operation as corresponding to either the spin-turn or the pivotal-turn when the first ratio (rf(t)/lb(t)) satisfies a mathematical formula (1) or when the second ratio (lf(t)/rb(t)) satisfies a mathematical formula (2). The symbol "ξ1" shown in the mathematical formula (1) and mathematical formula (2) is a predetermined value between 0.90 and a value less than 1.00, for example.

(Expression 1)

$$\xi_1 < \frac{rf(t)}{lb(t)} < \frac{1}{\xi_1} \tag{1}$$

$$\xi_1 < \frac{lf(t)}{rb(t)} < \frac{1}{\xi_1} \tag{2}$$

In the controller 60, the larger one of the first pilot pressure lf(t) and the fourth pilot pressure rb(t), when the mathematical formula (1) is satisfied, is defined as the first judgment value $pv_{Lspin}$, and the larger one of the second pilot pressure lb(t) and the third pilot pressure rf(t), when the mathematical formula (1) is satisfied, is defined as the second judgment value $pv_{Rspin}$. The controller 60 considers the traveling operation member 59 as being operated for either the spin-turn or the pivotal-turn based on the first judgment value $pv_{Lspin}$ and the second judgment value $pv_{Rspin}$. For example, when the first judgment value $pv_{Lspin}$ is smaller than a first average value corresponding to an average of the second pilot pressure lb(t) and the third pilot pressure rf(t), or when the second judgment value $pv_{Rspin}$ is smaller than a second average value corresponding to an average of the first pilot pressure lf(t) and the fourth pilot pressure rb(t), the controller 60 determines that the presently performed operation corresponds to the spin-turn. When the first judgment value $pv_{Lspin}$ is larger than or equal to the first average value, or when the second judgment value $pv_{Rspin}$ is larger than or equal to the second average value, the controller 60 determines that the presently performed operation corresponds to the pivotal-turn.

Specifically, the controller 60 calculates the first judgment value $pv_{Lspin}$ and the second judgment value $pv_{Rspin}$ according to a mathematical formula (3) and mathematical formula (4). The controller 60 determines the presently performed operation is that for the spin-turn when a mathematical formula (5) or mathematical formula (6) is satisfied, and the controller 60 determines that the presently performed operation is that for the pivotal-turn when mathematical formula (5) or mathematical formula (6) is not satisfied. The left side of the mathematical formula (5) is the first average value, and the left side of mathematical formula (6) is the second average value. The symbol "ξ2" shown in the mathematical formula (5) and mathematical formula (6) is a predetermined correction value, for example, a value around 0.5. The first average value may be "an average of the second pilot pressure lb(t) and the third pilot pressure rf(t)", and the second average value may be "an average of the first pilot pressure lf(t) and the fourth pilot pressure rb(t)". The symbol "ξ2" is a correction factor.

(Expression 2)

$$pv_{Lspin} = \max(rb_{(t)}, lf_{(t)}) \tag{3}$$

$$pv_{Rspin} = \max(lb(t), rf_{(t)}) \tag{4}$$

$$\frac{lb(t) + rf(t)}{2} \times \xi_2 > pv_{Lspin} \tag{5}$$

$$\frac{lf(t) + rb(t)}{2} \times \xi_2 > pv_{Rspin} \tag{6}$$

As described above, the controller 60 is capable of judging whether the presently performed operation corresponds to the spin-turn or the pivotal-turn of the working device 1 (machine body 2) based on the hydraulic pressures detected by the pressure detectors (including the first pressure detector 48*a*, the second pressure detector 48*b*, the third pressure detector 48*c*, and the fourth pressure detector 48*d*) provided on the traveling fluid line 45, that is, the pilot pressures [the first pilot pressure lf(t), the second pilot pressure lb(t), the third pilot pressure rf(t), and the fourth pilot pressure rb(t)].

Based on the first pilot pressure lf(t) detected by the first pressure detector 48*a*, the second pilot pressure lb(t) detected by the second traveling fluid line 45*b*, the third pilot pressure rf(t) detected by the third traveling fluid line 45*c*, and the fourth pilot pressure rb(t) detected by the fourth traveling fluid line 45*d*, the controller 60 is capable of judging whether the operation member 59 is operated for the spin-turn or the pivotal-turn.

The controller 60 determines that the presently performed operation corresponds to either a straight-traveling operation or the pivotal-turn operation when a third ratio of the third pilot pressure rf(t) to the first pilot pressure lf(t) is within a predetermined range, or when a fourth ratio of the fourth pilot pressure rb(t) to the second pilot pressure lb(t) is within the predetermined range. Specifically, when the third ratio (rf(t)/lf(t)) satisfies a mathematical formula (7) or when the fourth ratio (rb(t)/lb(t)) satisfies a mathematical formula (8), the controller 60 determines that the presently performed operation corresponds to either the straight-traveling or the pivotal-turn. The symbol "ξ1" shown in the mathematical formula (7) and the mathematical formula (8) is a predetermined value, for example, between 0.90 and a value less than 1.00.

(Expression 3)

$$\xi_1 < \frac{rf(t)}{lf(t)} < \frac{1}{\xi_1} \tag{7}$$

$$\xi_1 < \frac{rb(t)}{lb(t)} < \frac{1}{\xi_1} \tag{8}$$

In addition, when the larger one of the second pilot pressure lb(t) and the fourth pilot pressure rb(t) is defined as a first straight traveling value $pv_{Fstraight}$, and the larger one of the first pilot pressure lf(t) and the third pilot pressure rf(t) is defined as the second straight traveling value $pv_{Bstraight}$, the controller 60 judges, based on the first straight traveling value $pv_{Fstraight}$ and the second straight traveling value $pv_{Bstraight}$, whether the presently performed operation corresponds to either the straight-traveling or the pivotal-turn.

For example, the controller 60 determines that the presently performed operation corresponds to the straight-traveling when the first straight traveling value $pv_{Fstraight}$ is smaller than a third average value corresponding to an average of the first pilot pressure lf(t) and the third pilot pressure rf(t), or when the second straight traveling value $m_{straight}$ is smaller than a fourth average value corresponding to an average of the fourth pilot pressure rb(t) and the second pilot pressure lb(t). In addition, when the first straight traveling value $pv_{Fstraight}$ is larger than or equal to the third average value, or when the second straight traveling value $pv_{Bstraight}$ is larger than or equal to the fourth average value, the controller 60 considers the presently performed operation as corresponding to the pivotal-turn.

Specifically, the controller 60 calculates the first straight traveling value $pv_{Fstraight}$ and the second straight traveling value $pv_{Bstraight}$ according to a mathematical formula (9) and a mathematical formula (10). The controller 60 considers the presently performed operation as corresponding to the straight-traveling when a mathematical formula (11) or a mathematical formula (12) is satisfied. The controller 60 considers the presently performed operation as corresponding to the pivotal-turn when the mathematical formula (11) or the mathematical formula (12) is not satisfied. The left side of the mathematical formula (11) is the third average value, and the left side of the mathematical formula (12) is the fourth average value. The symbol "ξ2" shown in the mathematical formula (11) and the mathematical formula (12) is a predetermined correction value, for example, a value around 0.5.

(Expression 4)

$$pv_{Fstraight} = \max(lb_{(t)}, rb_{(t)}) \tag{9}$$

$$pv_{Bstraight} = \max(lf_{(t)}, rf_{(t)}) \tag{10}$$

$$\frac{rf(t) + lf(t)}{2} \times \xi_2 > pv_{Fstraight} \tag{11}$$

$$\frac{rb(t) + lb(t)}{2} \times \xi_2 > pv_{Bstraight} \tag{12}$$

As described above, the controller 60 is capable of judging whether the operation corresponds to the straight-traveling or the pivotal-turn of the working device 1 (machine body 2) based on the hydraulic pressures detected by the pressure detectors (including the first pressure detector 48*a*, the second pressure detector 48*b*, the third pressure detector 48*c*, and the fourth pressure detector 48*d*) provided on the traveling fluid line 45, that is, the pilot pressures [the first pilot pressure lf(t), the second pilot pressure lb(t), the third pilot pressure rf(t), and the fourth pilot pressure rb(t)].

In addition, when the straight-traveling of the working device 1 (machine body 2) is performed, the controller 60 is capable of judging how much a straight-travelling operation is, based on the first pilot pressure lf(t), the second pilot pressure lb(t), the third pilot pressure rf(t), and the fourth pilot pressure rb(t). Specifically, as shown in mathematical formulas (13) and (14), the controller 60 judges whether the third ratio (rf(t)/lf(t)) of the third pilot pressure rf(t) to the first pilot pressure lf(t) is within a predetermined range or not, and whether the fourth ratio (rb(t)/lb(t)) of the fourth pilot pressure rb(t) to the second pilot pressure lb(t) is in the predetermined range or not. The symbol "ξ3" shown in the mathematical formula (13) and the mathematical formula (14) is a predetermined value, for example, between 0.90 and a value less than 1.00.

(Expression 5)

$$\xi_3 < \frac{rf(t)}{lf(t)} < \frac{1}{\xi_3} \tag{13}$$

$$\xi_3 < \frac{rb(t)}{lb(t)} < \frac{1}{\xi_3} \tag{14}$$

In the controller 60, the larger one of the second pilot pressure lb(t) and the fourth pilot pressure rb(t), when the third ratio (rf(t)/lf(t)) is within the predetermined range, is defined as a first straight-traveling value $pv_{Fpivot}$, as shown in a mathematical formula (15).

(Expression 6)

$$pv_{Fpivot}=\max(lb_{(t)},rb_{(t)}) \quad (15)$$

In the controller 60, the larger one of the first pilot pressure lf(t) and the third pilot pressure rf(t), when the fourth ratio (rb(t)/lb(t)) is within the predetermined range, is defined as the second straight advance value $pv_{Bpivot}$, as shown in a mathematical formula (16).

(Expression 7)

$$pv_{Bpivot}=\max(lf_{(t)},rf_{(t)}) \quad (16)$$

As shown in a mathematical formula (17), the controller 60 calculates the straight traveling degree $S_{Fratio}(t)$ based on the first straight traveling value $pv_{pivot}$ and the third average value corresponding to the average of the first pilot pressure lf(t) and the third pilot pressure rf(t). And, as shown in Mathematical formula (18), the controller 60 calculates the straight-through degree $S_{Bratio}(t)$ based on the second straight-through value $pv_{pivot}$ and the fourth average value corresponding to the average of the second pilot pressure lb(t) and the fourth pilot pressure rb(t).

(Expression 8)

$$S_{Fratio(t)}=\left(\frac{rf(t)+lf(t)}{2}\right)/pv_{Fpivot} \quad (17)$$

$$S_{Bratio(t)}=\left(\frac{rb(t)+lb(t)}{2}\right)/pv_{Bpivot} \quad (18)$$

The controller 60 judges, based on the straight line degree $S_{Fratio}(t)$ and the straight line degree $S_{Bratio}(t)$, whether the vehicle is traveling straight. For example, the controller 60 determines that the straight traveling degree of the working device 1 (machine body 2) is large when the straight traveling degree $S_{Fratio}(t)$ or the straight traveling degree $S_{Bratio}(t)$ so large as exceeding 1.0.

Figure 3:
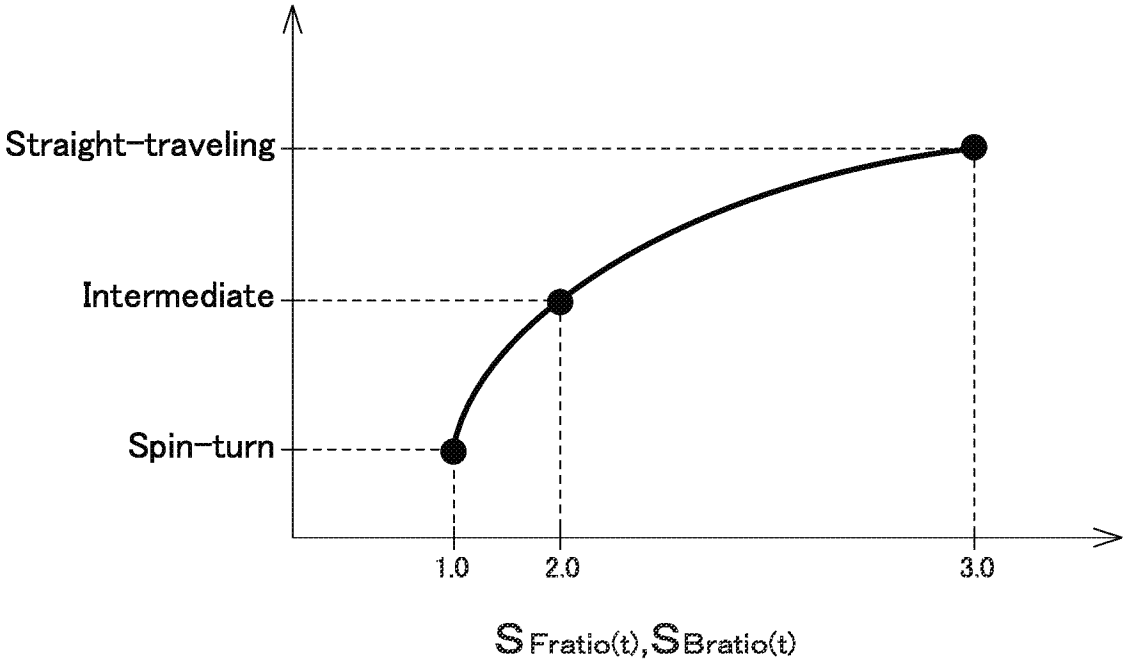
FIG. 3 is a view showing an example of changing of a straight traveling degree $S_{Fratio}$ (t).

FIG. 3 shows a change in the straight traveling degree $S_{Fratio}(t)$ when the first pilot pressure lf(t) and the third pilot pressure rf(t) are 3.0 MPa.

For example, when the first pilot pressure lf(t) and the third pilot pressure rf(t) are 3.0 MPa, the second straight traveling value $pv_{pivot}$ becomes 0.1 MP, and the straight traveling degree $S_{Fratio}(t)$ becomes a large value of 30. Thus, when the straight traveling degree $S_{Fratio}(t)$ is large, the controller 60 determines that the straight traveling degree is large. When the second pilot pressure lb(t) and the fourth pilot pressure rb(t) are substantially the same as the first pilot pressure lf(t) and the third pilot pressure rf(t), and when the second straight traveling value $pv_{pivot}$ is 3.0 MPa, a value of the straight traveling degree $S_{Fratio}(t)$ becomes 1.0. The second pilot pressure lb(t) and the fourth pilot pressure rb(t) are substantially halves of the first pilot pressure lf(t) and the third pilot pressure rf(t), the second straight traveling value $pv_{pivot}$ becomes 1.5 MPa, and a value of the straight traveling degree $S_{Fratio}(t)$ becomes 2.0.

In the example of FIG. 3, the controller 60 considers the presently performed operation as corresponding to the straight-traveling when either the straight traveling degree $S_{Fratio}(t)$ or the straight traveling degree $S_{Bratio}(t)$ is a large value exceeding 2.0.

As described above, the controller 60 is capable of calculating the straight traveling degree based on the pilot pressures [the first pilot pressure lf(t), the second pilot pressure lb(t), the third pilot pressure rf(t), the fourth pilot pressure rb(t)], and estimating, based on the straight traveling degree, how the operating member 59 is operated.

Based on the first pilot pressure lf(t) detected by the first pressure detector 48*a*, the second pilot pressure lb(t) detected by the second traveling fluid line 45*b*, the third pilot pressure rf(t) detected by the third traveling fluid line 45*c*, and the fourth pilot pressure rb(t) detected by the fourth traveling fluid line 45*d*, the controller 60 is capable of judging whether the operation member 59 is operated for either the spin-turn or the pivotal-turn or not.

When the first ratio of the third pilot pressure rf(t) to the second pilot pressure lb(t) to is within a predetermined range, or when the second ratio of the first pilot pressure lf(t) to the fourth pilot pressure rb(t) is within the predetermined range, the controller 60 considers the presently performed operation as corresponding to either the spin-turn or the pivotal-turn. Specifically, the controller 60 determines that the presently performed operation corresponds to either the spin-turn or the pivotal-turn when the first ratio (rf(t)/lb(t)) satisfies a mathematical formula (19) or when the second ratio (lf(t)/rb(t)) satisfies a mathematical formula (20). The symbol "ξ1" shown in the mathematical formula (19) and the mathematical formula (20) is a predetermined value, for example, between 0.90 and a value less than 1.00.

(Expression 9)

$$\xi_1<\frac{rf(t)}{lb(t)}<\frac{1}{\xi_1} \quad (19)$$

$$\xi_1<\frac{lf(t)}{rb(t)}<\frac{1}{\xi_1} \quad (20)$$

In the controller 60, the larger one of the first pilot pressure lf(t) and the fourth pilot pressure rb(t), when the mathematical formula (19) is satisfied, is defined as the first judgment value $pv_{Lspin}$ as shown in a mathematical formula (21), and the larger one of the third pilot pressure rf(t) and the second pilot pressure lb(t), when the mathematical formula (20) is satisfied, is defined as the second judgment value $pv_{Rspin}$ as shown in a mathematical formula (22). The controller 60 judges, based on the first judgment value $pv_{Lspin}$ and the second judgment value $pv_{Rspin}$, whether the traveling operation member 59 is operated for either the spin-turn or the pivotal-turn.

(Expression 10)

$$pv_{Lspin}=\max(rb_{(t)},lf_{(t)}) \quad (21)$$

$$pv_{Rspin}=\max(lb(t),rf_{(t)}) \quad (22)$$

The controller 60 may calculate a left turn degree $S_{Lratio}(t)$ based on the first average value (corresponding to a right side of a mathematical formula 23) and the first judgment value $pv_{Lspin}$, may calculate a right turn degree $S_{Rratio}(t)$ based on the second average value (corresponding to a right side of a mathematical formula 24) and the second judgment value $pv_{Rspin}$, may judge, based on the left turn degree $S_{Lratio}(t)$, whether the presently performed operation corresponds to either the left spin-turn or the left pivotal-turn or not, and may judge, based on the right turn degree $S_{Rratio}(t)$, whether the presently performed operation corresponds to either the right spin-turn or the right pivotal-turn or not.

Specifically, the controller 60 calculates the left turn degree $S_{Lratio}(t)$ according to a mathematical formula (23), and calculates the right turn degree $S_{Rratio}(t)$ according to a mathematical formula (24).

(Expression 11)

$$S_{Lratio(t)} = pv_{Lspin} / \left( \frac{rf(t) + lb(t)}{2} \right) \quad (23)$$

$$S_{Rratio(t)} = pv_{Rspin} / \left( \frac{lf(t) + rb(t)}{2} \right) \quad (24)$$

The controller 60 considers the presently performed operation as corresponding to the left spin-turn when the left turn degree $S_{Lratio}(t)$ is 0.5 or less and close to zero (0.1 or less), and considers the presently performed operation as corresponding to the left pivotal-turn when the left turn degree $S_{Lratio}(t)$ is more than 0.5 and close to 1.0 (0.9 or more). The controller 60 considers the presently performed operation as corresponding to the right spin-turn when the right turn degree $S_{Rratio}(t)$ is 0.5 or less and close to zero (0.1 or less), and considers the presently performed operation as corresponding to the right pivotal-turn when the right turn degree $S_{Rratio}(t)$ is more than 0.5 and close to 1.0 (0.9 or more).

Figure 4:
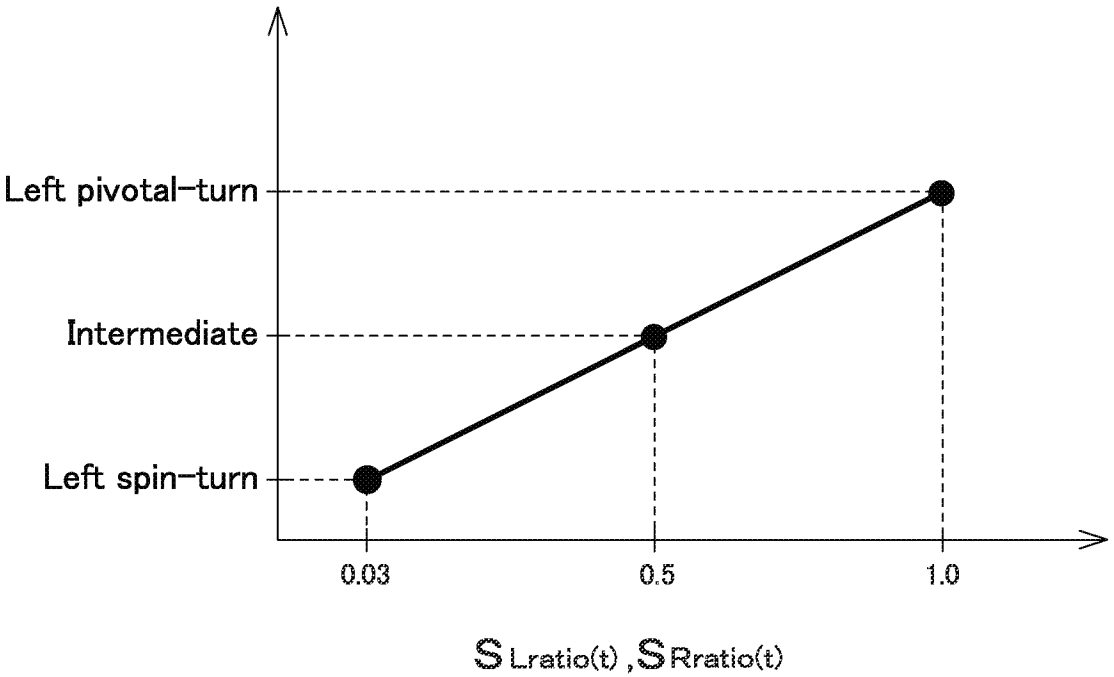
FIG. 4 is a view showing an example of changing of a left-turn degree $S_{Lratio}$ (t).

FIG. 4 shows a change in the left turn degree $S_{Lratio}(t)$ when the second pilot pressure lb(t) and the third pilot pressure rf(t) are 3.0 MPa.

When the first pilot pressure lf(t) and the fourth pilot pressure rb(t) are very small, e.g., when the first judgment value $pv_{Lspin}$ is 0.1 MPa, the value of the left turn degree $S_{Lratio}(t)$ is 0.03, which is a small value, and the presently performed operation is considered as corresponding to the left spin-turn.

For example, the presently performed operation can be considered as corresponding to the left pivotal-turn when the first pilot pressure lf(t) and the fourth pilot pressure rb(t) are 3.0 MPa, which are almost the same as the second pilot pressure lb(t) and the third pilot pressure rf(t), the first judgment value $pv_{Lspin}$ is 3.0 MPa, and the value of the left turn degree $S_{Lratio}(t)$ is 1.0. The presently performed operation can be considered as corresponding to the left pivotal-turn when the three pressures among the first pilot pressure lf(t), the second pilot pressure lb(t), the third pilot pressure rf(t), and the fourth pilot pressure rb(t) are almost the same, for example, when the first pilot pressure lf(t) is 3.0 MPa, the fourth pilot pressure rb(t) is less than 3.0 MPa, the first judgment value $pv_{Lspin}$ is 3.0 MPa, and the value of the left turn degree $S_{Lratio}(t)$ is 1.0.

In a case where the first pilot pressure lf(t) and the fourth pilot pressure rb(t) are, for example, 1.5 MPa, which are substantially halves of the second pilot pressure lb(t) and the third pilot pressure rf(t), the presently performed operation can be considered as corresponding to a left turning in an intermediate state between the left pivotal-turn and the left spin-turn when the first judgment value $pv_{Lspin}$ is 1.5 MPa and the value of the left turn degree $S_{Lratio}(t)$ is 0.5.

As described above, the controller 60 can determine, based on the pilot pressures [the first pilot pressure lf(t), the second pilot pressure lb(t), the third pilot pressure rf(t), the fourth pilot pressure rb(t)], whether the traveling operation member 59 is operated for either the left pivotal-turn or spin-turn or the right pivotal-turn or spin-turn.

Thus, the traveling operation member 59 operable in various operation states can be considered as being in the straight-traveling state or the left or right pivotal-turning state or spin-turning state or as having any straight-traveling degree, for example. how much, the operated in the straight-traveling operation direction, the left or right pivotal-turn direction, the straight-traveling degree, the spin-turn, and the like. Accordingly, the presently performed operation state of the operation members 59 can be displayed on a display provided in the machine body 2 (around the driver seat), thereby improving the operability.

The controller 60 may perform the automatic deceleration and the returning from the automatic deceleration based on the determined operational direction of the traveling operation member 59. For example, the automatic deceleration may be performed when the operational direction of the traveling operation member 59 is considered as corresponding to the spin-turn. In this regard, any processing may be performed after the determination of the operational direction of the traveling operation member 59. In addition, when the traveling operation member 59 is considered as being operated for the spin-turn or the pivotal-turn, the returning from the automatic deceleration may be performed to terminate the automatic deceleration.

The controller 60 considers the traveling operating member 59 as being at the neutral position N when all of the first pilot pressures lf(t) to fourth pilot pressures rb(t) are each a certain value or less. Then, when the controller 60 detects that all of the first pilot pressures lf(t) to fourth pilot pressures rb(t) are less than or equal to the aforementioned certain value (that when the traveling operation member 59 is at the neutral position N) during the automatic deceleration, the controller 60 performs the returning from the automatic deceleration.

Figure 5:
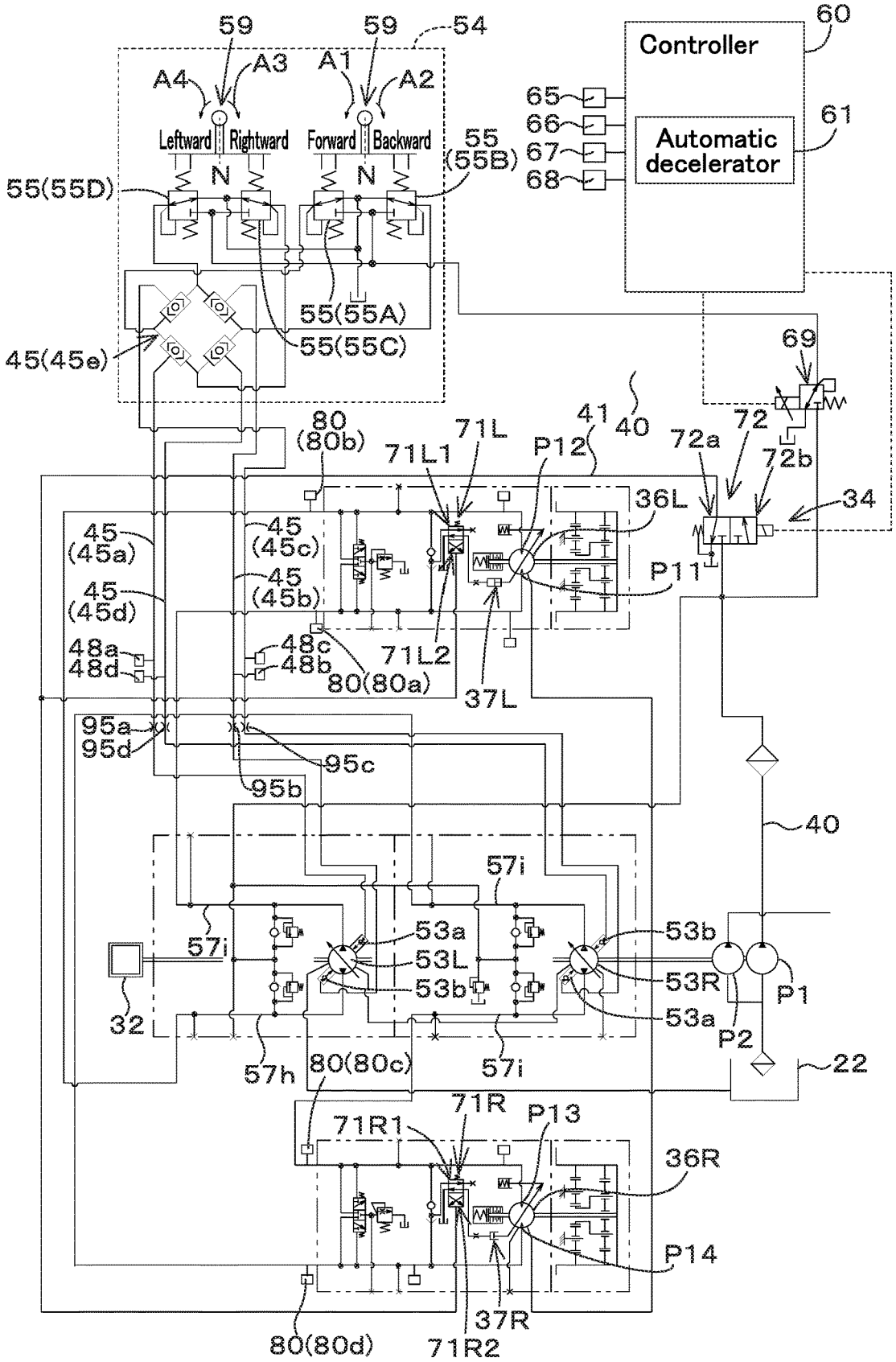
FIG. 5 is a view showing a modified example of the hydraulic system (the hydraulic circuit) for the working machine.

As shown in FIG. 5, an actuation valve 69 including an electromagnetic proportional valve or the like may be provided in the delivery fluid line 40. The actuation valve 69 has an opening degree variable according to an amount of dropping (reduction amount) of a rotation speed of the prime mover so as to control the pressure of hydraulic fluid supplied to the traveling operation device 54, thereby preventing stalling of the prime mover, i.e., the engine stall. In addition, the actuation valve 69 may function as a valve for preventing the engine stalling or as any other valve, and is not limited thereto.

For example, when the straight traveling degree $S_{Fratio}(t)$ and the straight traveling degree $S_{Bratio}(t)$ are each in a predetermined value, the opening degree of the actuation valve 69 can be changed to reduce the pressure of hydraulic fluid output from the actuation valve 69 compared to a case where each of the straight traveling degree $S_{Fratio}(t)$ and the straight traveling degree $S_{Bratio}(t)$ is different from the predetermined value.

Specifically, the upper limit of the pressure of the hydraulic fluid flowing in the traveling fluid line 45 from the operating valve 55 can be lowered by reducing the pressure of hydraulic fluid output from the actuation valve 69 from 3.0 MPa when the straight traveling degree $S_{Fratio}(t)$ and the straight traveling degree $S_{Bratio}(t)$ are each in a range between 3.0 to 6.0, for example. In this manner, the first pilot pressure lf(t), the second pilot pressure lb(t), the third pilot pressure rf(t), and the fourth pilot pressure rb(t) can be reduced without changing the first straight traveling value $pv_{pivot}$ and the second straight traveling value $pv_{pivot}$. Accordingly, the straight traveling degree $S_{Fratio}(t)$ and the straight traveling degree $S_{Bratio}(t)$ are reduced, so that the vehicle can be turned easily when the switching from straight-traveling operation to the turning operation is performed.

In more detail, for example, in a case where the first pilot pressure lf(t) and the third pilot pressure rf(t) are 3.0 MPa and the second pilot pressure lb(t) and the fourth pilot pressure rb(t) are 0 MPa, and the operating member 59 is operated so as to gradually increase the second pilot pressure lb(t), the opening degree of the actuation valve 69 is changed to reduce the pressure of hydraulic fluid output from the actuation valve 69 to 2.7 MPa when the second pilot pressure lb(t) exceeds 0.5 MPa and the straight traveling degree $S_{Fratio}(t)$ becomes less than 6.0.

Accordingly, when a relatively large traveling load is generated except a case where there is a risk of the engine stalling, for example, when the straight traveling degree $S_{Fratio}(t)$ and the straight traveling degree $S_{Bratio}(t)$ are 6.0 or higher and the pair of traveling devices 5L and 5R travel substantially straight, or when the straight traveling degree $S_{Fratio}(t)$ and the straight traveling degree $S_{Bratio}(t)$ is 3.0 or less and the pair of traveling devices 5L and 5R turn, the actuating valve 69 maintains a high pressure of the hydraulic fluid.

The controller 60 may change the control of the actuation valve based on the determined operational direction of the traveling operating member 59.

The determination of the presently performed operation of the traveling operating member 54 may be performed in the following method which is based on a combination of the first pilot pressure lf(t), the second pilot pressure lb(t), the third pilot pressure rf(t), and the fourth pilot pressure rb(t).

First, a case of the spin turn will be described.

In the case of the spin turn, when a first differential pressure (ΔPpL: lf(t)−lb(t)), which is a value obtained by subtracting the second pilot pressure lb(t) applied to the second pressure-receiving portion 53*b* of the left traveling pump 53L from the first pilot pressure lf(t) applied to the first pressure receiver 53*a* of the left traveling pump 53L is opposite in positive/negative to a second differential pressure (ΔPpR: rf(t)−rb(t)), which is a value obtained by subtracting the fourth pilot pressure rb(t) applied to the fourth pressure-receiving portion 53*b* of the right traveling pump 53R from the third pilot pressure rf(t) applied to the third pressure-receiving portion 53*a* of the right traveling pump 53R, the controller 60 considers the traveling operation member 59 as being operated for the spin-turn. That is, when one of the first differential pressure (ΔPpL) and the second differential pressure (ΔPpR) is positive and the other is negative, the presently performed operation is determined as corresponding to the spin-turn. Specifically, when the ΔPpL is positive and the ΔPpR is negative, the presently performed operation is determined as corresponding to the right spin-turn, and when the ΔPpL is negative and the ΔPpR is positive, the presently performed operation is determined as corresponding to the left spin-turn.

Next, a case of small and large turns will be described.

The small turn is a turn with a moderate turning radius. The large turn is a turn with a larger turning radius than that of the small turn.

First, the right small turn, will be described.

It is judged whether the operation state of the traveling operation member 59 corresponds to the right small turn based on a threshold set for the lf(t) (a first threshold) and a threshold set for the ΔPpR (a second threshold). Specifically, the controller 60 considers the presently performed operation as corresponding to the right small turn in the right direction when the lf(t) is equal to or greater than the first threshold and the ΔPpR is equal to or less than the second threshold.

In the case of judging whether the presently performed operation corresponds to the right small turn, considering that the rb(t) in ΔPpR (rf(t)−rb(t)) may be a sufficiently small value, the judgment of the operation state of the traveling operation member 59 may also be based on the threshold (the first threshold) set for the lf(t) and a threshold (a fifth threshold) set for the rf(t). Specifically, when the lf(t) is equal to or greater than the first threshold and the rf(t) is equal to or less than the fifth threshold, the controller 60 can consider the presently performed operation as corresponding to the right small turn.

Next, the case of a left small turn will be described.

It is judged whether the operation state of the traveling operation member 59 corresponds to the left small turn according to a threshold set for the rf(t) (a third threshold) and a threshold set for the ΔPpL (a fourth threshold). Specifically, the controller 60 considers the presently performed operation as corresponding to the left small turn when the rf(t) is equal to or greater than the third threshold and the ΔPpL is equal to or less than the fourth threshold.

In the case of judging whether the presently performed operation corresponds to the left small turn, considering that the lb(t) in the ΔPpL (lf(t)−lb(t)) may be a sufficiently small value, the judgment of the operation state of the traveling operation member 59 may also be based on the threshold set for the rf(t) (the third threshold) and the threshold set for the lf(t) (the sixth threshold). Specifically, the controller 60 can consider the presently performed operation as corresponding to the left small turn when the rf(t) is equal to or greater than the third threshold and the lf(t) is equal to or less than the sixth threshold.

Next, the case of the right large turn will be described.

It is judged whether the operation state of the traveling operation member 59 corresponds to the right large turn based on a threshold set for the lf(t) (a seventh threshold) and a threshold set for the ΔPpR (an eighth threshold). Specifically, when the lf(t) is equal to or greater than the seventh threshold and the ΔPpR is equal to or greater than the eighth threshold, the controller 60 considers the presently performed operation as corresponding to the right large turn.

In the case of judging whether the presently performed operation corresponds to the right large turn, considering that the rb(t) in the ΔPpR (rf(t)−rb(t)) may be a sufficiently small value, the judgment of the operation state of the traveling operation member 59 may also be based on the threshold set for the first pilot pressure lf(t) (the seventh threshold) and a threshold set for the rf(t) (an eleventh threshold). Specifically, the controller 60 can consider the presently performed operation as corresponding to the right large turn when the lf(t) is equal to or greater than the seventh threshold and the rf(t) is equal to or less than the seventh threshold and equal to or greater than the eleventh threshold.

Next, the left large turn will be described.

It is judged whether the operation state of the traveling operation member 59 corresponds to the left large turn based on a threshold set for the rf(t) (a ninth threshold) and a threshold set for the ΔPpL (a tenth threshold). Specifically, when the rf(t) is equal to or greater than the ninth threshold and the ΔPpR is equal to or greater than the tenth threshold, the controller 60 considers the presently performed operation as corresponding to the left large turn.

In the case of judging whether the presently performed operation corresponds to the left large turn, considering that the lb(t) in ΔPpL (lf(t)−lb(t)) may be a sufficiently small value, the judgment of the operation state of the traveling operation member 59 may also be based on the threshold set for the rf(t) (the ninth threshold) and the threshold set for the lf(t) (a twelfth threshold). Specifically, the controller 60 can consider the presently performed operation as corresponding to the left large turn when the rf(t) is larger than or equal to the ninth threshold and the lf(t) is less than or equal to the ninth threshold and greater than or equal to the twelfth threshold.

In the above-mentioned manner, it is possible to judge whether the operator's operation of the traveling operation member 59 corresponds to the small turn, the large turn, or the spin-turn based on a combination of the pilot pressures (the first pilot pressure lf(t), second pilot pressure lb(t), third pilot pressure rf(t), and fourth pilot pressure rb(t)) detected by the four pressure detectors (i.e., the first to fourth pressure detectors 80*a* to 80*d*) provided on the respective four traveling fluid lines (i.e., the first to fourth traveling fluid lines 45*a* to 45*d*) connected to the pressure receiving portions 53*a* and 53*b* of the traveling pumps 53L and 53R.

In the above method for determining the operation corresponding to the small turn and the large turn, a plurality of thresholds may each serve as the second threshold and a plurality of thresholds may each serve as the fourth threshold, or a single threshold may serve as each of the second threshold and the fourth threshold. In addition, a plurality of thresholds may each serve as the eighth threshold and a plurality of thresholds may each serve as the tenth threshold, or a single threshold may serve as each of the eighth threshold and the tenth threshold.

Figure 6:
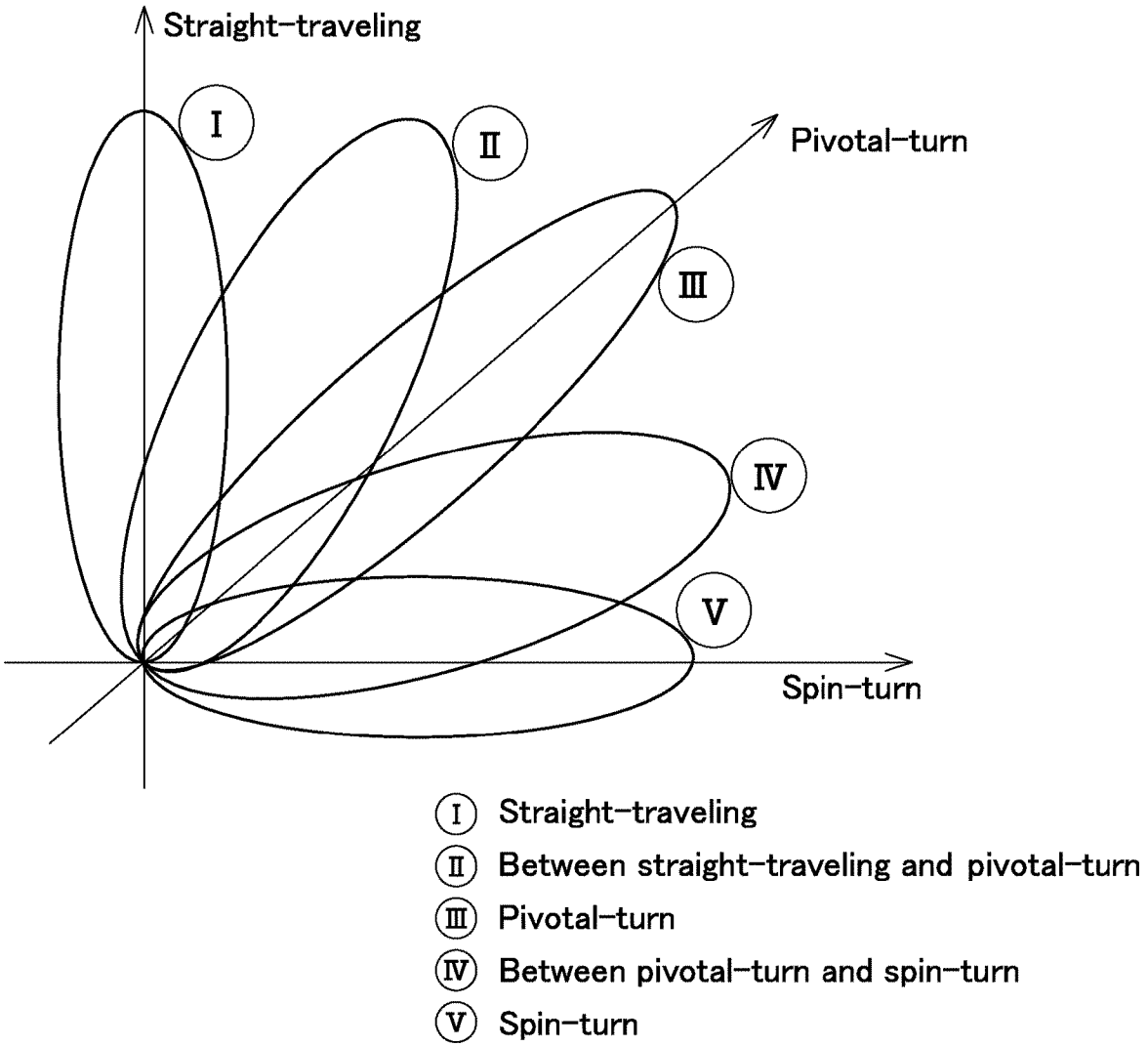
FIG. 6 is a view showing a traveling direction of the working machine.

FIG. 6 is an image diagram showing the straight-traveling and the right-turn distinguished from each other based on a turning degree.

In FIG. 6, a symbol "I" represents the straight-traveling, a symbol "II" represents the turning between the straight-traveling and the pivotal-turn, a symbol "III" represents the pivotal-turn, a symbol "IV" represents the turning between the pivotal-turn and the spin-turn, and a symbol "V" represents the spin-turn.

In the above method for determining the operations corresponding to the small turn and the large turn, the threshold value to be compared with the second differential pressure (ΔPpR) for judging the right turn can be determined to a positive value or to zero or a negative value in the case of judging the right turn. By changing the threshold value, any of the turning degrees in the II to IV can be determined. In detail, when the threshold is set to a positive value, it can be determined as the turn in the II, when the threshold value is set to a small positive value, it can be determined as the turn in the III, and when the threshold value is set to zero or negative, it can be determined as the turn in the IV. That is, by setting a plurality of threshold values, it is possible to determine which turning categories of the II to IV the operation of the traveling operation member 59 corresponds to.

Since the above idea is the same in the case of the left turn, the explanation for the case of the left turn is omitted.

The work machine 1 includes the machine body 2, the left traveling device 5L provided on a left portion of the machine body 2, the right traveling device 5R provided on a right portion of the machine body 2, the left traveling motor 36L configured to output power to the left traveling device 5L, the right traveling motor 36R configured to output power to the right traveling device 5R, the left traveling pump 53L to supply operation fluid to the left traveling motor 36L, the left traveling pump 53L including the first pressure receiving portion 53*a* and the second pressure receiving portion 53*b* so that the operation fluid is used to apply a pressure to at least one of the first and second pressure receiving portions 53*a* and 53*b*, the right traveling pump 53R to supply operation fluid to the right traveling motor 36R, the right traveling pump 53R including the third pressure receiving portion 53*a* and the fourth pressure receiving portion 53*b* so that the operation fluid is used to apply a pressure to at least one of the third and fourth pressure receiving portions 53*a* and 53*b*, the traveling operation device 54 including the traveling operation member 59 and configured to apply the pressure of operation fluid to at least one of the first, second, third and fourth pressure receiving portions 53*a*, 53*b*, 53*c* and 53*b* according to operation of the traveling operation member 59, the first traveling fluid line 45*a* connected to the first pressure receiving portion 53*a*, the operation fluid having the pressure applied to the first pressure receiving portion 53*a* being passed through the first traveling fluid line 45*a* according to operation of the traveling operation member 59, the second traveling fluid line 45*b* connected to the second pressure receiving portion 53*b*, the operation fluid having the pressure applied to the second pressure receiving portion 53*b* being passed through the second traveling fluid line 45*b* according to operation of the traveling operation member 59, the third traveling fluid line 45*c* connected to the third pressure receiving portion 53*a*, the operation fluid having the pressure applied to the third pressure receiving portion 53*a* being passed through the third traveling fluid line 45*c* according to operation of the traveling operation member 59, the fourth traveling fluid line 45*d* connected to the fourth pressure receiving portion 53*b*, the operation fluid having the pressure applied to the fourth pressure receiving portion 53*b* being passed through the fourth traveling fluid line 45*d* according to operation of the traveling operation member 59, the first pressure detector 48*a* configured to detect the first pilot pressure lf(t) that is the pressure of operation fluid passed through the first traveling fluid line 45*a*, the second pressure detector 48*b* configured to detect the second pilot pressure lb(t) that is the pressure of operation fluid passed through the second traveling fluid line 45*b*, the third pressure detector 48*c* configured to detect the third pilot pressure rf(t) that is the pressure of operation fluid passed through the third traveling fluid line 45*c*, the fourth pressure detector 48*d* configured to detect the fourth pilot pressure rb(t) that is the pressure of operation fluid passed through the fourth traveling fluid line 45*d*, and the controller 60 configured or programed to judge, based on the first, second, third and fourth pilot pressures lf(t), lb(t), rf(t) and rb(t), whether the traveling operation member 59 is operated in a direction corresponding to any of the spin-turn, the pivotal-turn and the straight-traveling.

According to this configuration, based on the pressures of the hydraulic fluid (the first pilot pressure lf(t), second pilot pressure lb(t), third pilot pressure rf(t), and fourth pilot pressure rb(t)) in the traveling fluid lines 45 (the first traveling fluid line 45*a*, second traveling fluid line 45*b*, third traveling fluid line 45*c*, and fourth traveling fluid line 45*d*), it can be easily determine whether the operation corresponds to either the a spin-turn, the pivotal-turn, or the straight-traveling.

The controller 60 is configured or programmed to judge whether the traveling operation member 59 is operated in the direction corresponding to either the spin-turn or the pivotal-turn or not when the first ratio between the second pilot pressure lb(t) and the third pilot pressure rf(t) is within the predetermined range or when the second ratio between the first pilot pressure lf(t) and the fourth pilot pressure rb(t) is within the predetermined ratio.

According to this configuration, it can be easily determined whether the presently performed operation corresponds to either the spin-turn or the pivotal-turn based on the ratio (the first ratio) between the pilot pressure corresponding to the reverse-rotation direction of the left traveling pump 53L (the second pilot pressure lb(t)) and the pilot pressure corresponding to the normal-rotation direction of the right traveling pump 53R (the third pilot pressure rf(t)). In addition, it can be easily determined whether the presently performed operation corresponds to either the spin-turn or the pivotal-turn based on the ratio (the second ratio) between the pilot pressure corresponding to the normal-rotation direction of the left traveling pump 53L (the first pilot pressure lf(t)) and the pilot pressure corresponding to the reverse-rotation direction of the right traveling pump 53R (the fourth pilot pressure rb(t)).

The controller 60 is configured or programmed to whether the traveling operation member 59 is operated in a direction corresponding to either the spin-turn or the pivotal-turn or not based on the first judgment value that is a larger one of the first and fourth pilot pressures lf(t) and rb(t) and the second judgment value that is a larger one of the second and third pilot pressures lb(t) and rf(t). According to this configuration, it can be easily determined whether the presently performed operation corresponds to either the spin-turn or the pivotal-turn based on the larger one of the pilot pressure corresponding to the normal-rotation direction of the left traveling pump 53L (the first pilot pressure lf(t)) and the pilot pressure corresponding to the reverse-rotation direction of the right traveling pump 53R (the fourth pilot pressure rb(t)), and on the larger one of the pilot pressure corresponding to the reverse-rotation direction of the left traveling pump 53L (the second pilot pressure lb(t)) and the pilot pressure corresponding to the normal-rotation direction of the right traveling pump 53R (the third pilot pressure rf(t)).

The controller 60 is configured or programmed to consider the traveling operation member 59 as being operated in the direction corresponding to the spin-turn when the first judgment value is less than the first average value corresponding to the average of the second and third pilot pressures lb(t) and rf(t) or when the second judgment value is less than the second average value corresponding to the average of the first and fourth pilot pressures lf(t) and rb(t), and to consider the traveling operation member 59 as being operated in the direction corresponding to the pivotal-turn when the first judgment value is not less than the first average value or when the second judgment value is not less than the second average value.

According to this configuration, it can be easily determined that the presently performed operation corresponds to the pivotal-turn based on the average of the pilot pressure corresponding to the reverse-rotation direction of the left traveling pump 53L (the second pilot pressure lb(t)), the pilot pressure corresponding to the normal-rotation direction of the right traveling pump 53R (the third pilot pressure rf(t)), the pilot pressure corresponding to the normal-rotation direction of the left traveling pump 53L (the first pilot pressure lf(t)), and the pilot pressure corresponding to the reverse-rotation direction of the right traveling pump 53R (the fourth pilot pressure rb(t)).

The controller 60 is configured or programmed to judge whether the third ratio between the first pilot pressure lf(t) and the third pilot pressure rf(t) is within the predetermined range or not and whether the fourth ratio between the second pilot pressure lb(t) and the fourth pilot pressure rb(t) is within the predetermined range or not, to define a larger one of the second pilot pressure lb(t) and the fourth pilot pressure rb(t) as the first straight traveling value when the third ratio is within the predetermined range, to define a larger one of the first pilot pressure lf(t) and the third pilot pressure rf(t) as the second straight traveling value when the fourth ratio is within the predetermined range, to calculate the straight traveling degree based on the third average value corresponding to the average of the first and third pilot pressures lf(t) and rf(t) and on the first straight traveling value, to calculate the straight traveling degree based on the fourth average value corresponding to the average of the second and fourth pilot pressures lb(t) and rb(t) and on the second straight traveling value, and to judge whether the traveling operation member 59 is operated in the direction corresponding to the straight-traveling or not based on the calculated straight traveling degree.

According to this configuration, it can be easily judges whether the operation corresponds to the straight-traveling based on the straight traveling degree defined based on the first pilot pressure lf(t), the second pilot pressure lb(t), the third pilot pressure rf(t), and the fourth pilot pressure rb(t).

The controller 60 is configured or programmed to judge whether the first ratio between the second pilot pressure lb(t) and the third pilot pressure rf(t) is within the predetermined range or not and whether the second ratio between the first pilot pressure lf(t) and the fourth pilot pressure rb(t) is within the predetermined range or not, to define a larger one of the first pilot pressure lf(t) and the fourth pilot pressure rb(t) as the first judgment value when the first ratio is within the predetermined range, to define a larger one of the second pilot pressure lb(t) and the third pilot pressure rf(t) as the second judgment value when the second ratio is within the predetermined range, to calculate the left turning degree based on the first average value corresponding to the average of the second and third pilot pressures lb(t) and rf(t) and on the first judgment value, to calculate the right turning degree based on the second average value corresponding to the average of the first and fourth pilot pressures lf(t) and rb(t) and on the second judgment value, and to judge whether the traveling operation member 59 is operated for left turning of the working machine 1 in the direction corresponding to the spin-turn or the pivotal-turn based on the calculated left turning degree, and to judge whether the traveling operation member 59 is operated for right turning of the working machine 1 in the direction corresponding to the spin-turn or the pivotal-turn based on the calculated right turning degree.

According to this configuration, it can be determined that the presently performed operation corresponds to the turning (the spin-turn, the pivotal-turn) based on the correspondence between the first pilot pressure lf(t), the second pilot pressure lb(t), the third pilot pressure rf(t), and the fourth pilot pressure rb(t), and further, it can be judged whether the operation corresponds to the spin-turn or the pivotal-turn based on the degree of turn.

The controller 60 is configured or programmed to consider the traveling operation member 59 as being operated in the direction corresponding to the spin-turn when either one of the first differential pressure (ΔPpL)) acquired by subtracting the second pilot pressure lb(t) from the first pilot pressure lf(t) and the second differential pressure (ΔPpR) acquired by subtracting the fourth pilot pressure rb(t) from the third pilot pressure rf(t) is a positive number and the other is a negative number.

In addition, the controller 60 is configured or programmed to consider the traveling operation member 59 as being operated in the direction corresponding to the small turn of the working machine 1 along a middle turning circle when the first pilot pressure lf(t) is not less than the first threshold and the second differential pressure acquired by subtracting the fourth pilot pressure rb(t) from the third pilot pressure rf(t) is not more than the second threshold or when the third pilot pressure rf(t) is not less than the third threshold and the first differential pressure acquired by subtracting the second pilot pressure lb(t) from the first pilot pressure lf(t) is not more than the fourth threshold.

The controller 60 is configured or programmed to consider the traveling operation member 59 as being operated in the direction corresponding to the small turn of the working machine 1 along a middle turning circle when the first pilot pressure lf(t) is not less than the first threshold and the third pilot pressure rf(t) is not more than the fifth threshold or when the third pilot pressure rf(t) is not less than the third threshold and the first pilot pressure lf(t) is not more than the sixth threshold.

In addition, the controller 60 is configured or programmed to consider the traveling operation member 59 as being operated in the direction corresponding to the large turn of the working machine 1 along a large turning circle that is radially larger than the middle turning circle for the small turn of the working machine 1 when the first pilot pressure lf(t) is not less than the seventh threshold and the second differential pressure acquired by subtracting the fourth pilot pressure rb(t) from the third pilot pressure rf(t) is not less than the eighth threshold or when the third pilot pressure rf(t) is not less than the ninth threshold and the first differential pressure acquired by subtracting the second pilot pressure from the first pilot pressure is not less than the tenth threshold.

In addition, the controller 60 is configured or programmed to consider the traveling operation member 59 as being operated in the direction corresponding to the large turn of the working machine 1 along the large turning circle that is radially larger than the middle turning circle for the small turn of the working machine 1 when the first pilot pressure lf(t) is not less than the seventh threshold and the third pilot pressure rf(t) is not more than the seventh threshold and is not less than the eleventh threshold or when the third pilot pressure rf(t) is not less than the ninth threshold and the first pilot pressure lf(t) is not more than the ninth threshold and not less than the twelfth threshold.

According to these judgment methods, it can be judged whether the presently performed operation of the traveling operation member 59 by an operator corresponds to the small turn, to the large turn, or to the spin-turn based on a combination of the pilot pressures (first pilot pressure lf(t), second pilot pressure lb(t), third pilot pressure rf(t), fourth pilot pressure r b(t)) of the four pressure detectors (the first pressure detector 80*a* to the fourth pressure detector 80*d*) provided in the first traveling fluid line 45*a* to the fourth traveling fluid line 45*d*.

A plurality of values are each provided as the second threshold, and a plurality of values are each provided as the fourth threshold.

A plurality of values are each provided as the eighth threshold, and a plurality of values are each provided as the tenth threshold.

In addition, the left traveling motor 36L is rotated at a speed shiftable between a first speed and a second speed faster than the first speed, the right traveling motor 36R is rotated at a speed shiftable between a first speed and a second speed faster than the first speed, and the controller 60 is configured or programmed: to perform automatic deceleration to automatically reduce rotation speeds of the left and right traveling motors 36L and 36R by shifting from the second speed to the first speed; to perform automatic speed-restoration to automatically restore the rotation speeds of the left and right traveling motors 36L and 36R before performing the automatic deceleration by shifting from the first speed to the second speed; and to judge whether to perform the automatic deceleration and whether to perform the automatic speed-restoration based on which direction the traveling operation member 59 is considered as being operated in.

In addition, the controller 60 is configured or programmed: to consider the traveling operation member 59 as being at the neutral position N when the first to fourth pilot pressures lf(t) to rb(t) are each not more than the predetermined value; and to perform the automatic speed-restoration when the automatic deceleration is performed and all the first to fourth pilot pressures lf(t) to rb(t) are each detected as being not more than the predetermined value.

In addition, the working machine 1 further includes the actuation valve 69 to control a pressure of the operation fluid supplied to the traveling operation device 54. The controller 60 is configured or programmed to change control of the actuation valve 69 based on which direction the traveling operation member 59 is considered as being operated in.

The work machine 1 includes the machine body 2, the left traveling device 5L provided on a left portion of the machine body 2, the right traveling device 5R provided on a right portion of the machine body 2, the left traveling motor 36L configured to output power to the left traveling device 5L, the right traveling motor 36R configured to output power to the right traveling device 5R, the left traveling pump 53L to supply operation fluid to the left traveling motor 36L, the left traveling pump 53L including the first pressure receiving portion 53*a* and the second pressure receiving portion 53*b* so that the operation fluid is used to apply a pressure to at least one of the first and second pressure receiving portions 53*a* and 53*b*, the right traveling pump 53R to supply operation fluid to the right traveling motor 36R, the right traveling pump 53R including the third pressure receiving portion 53*a* and the fourth pressure receiving portion 53*b* so that the operation fluid is used to apply a pressure to at least one of the third and fourth pressure receiving portions 53*a* and 53*b*, the traveling operation device 54 including the traveling operation member 59 and configured to apply the pressure of operation fluid to at least one of the first, second, third and fourth pressure receiving portions 53*a*, 53*b*, 53*c* and 53*d* according to operation of the traveling operation member 59, the first traveling fluid line 45*a* connected to the first pressure receiving portion 53*a*, the operation fluid having the pressure applied to the first pressure receiving portion 53*a* being passed through the first traveling fluid line 45*a* according to operation of the traveling operation member 59, the second traveling fluid line 45*b* connected to the second pressure receiving portion 53*b*, the operation fluid having the pressure applied to the second pressure receiving portion 53*b* being passed through the second traveling fluid line 45*b* according to operation of the traveling operation member 59, the third traveling fluid line 45*c* connected to the third pressure receiving portion 53*a*, the operation fluid having the pressure applied to the third pressure receiving portion 53*a* being passed through the third traveling fluid line 45*c* according to operation of the traveling operation member 59, the fourth traveling fluid line 45*d* connected to the fourth pressure receiving portion 53*b*, the operation fluid having the pressure applied to the fourth pressure receiving portion 53*b* being passed through the fourth traveling fluid line 45*d* according to operation of the traveling operation member 59, the first pressure detector 48*a* configured to detect the first pilot pressure lf(t) that is the pressure of operation fluid passed through the first traveling fluid line 45*a*, the second pressure detector 48*b* configured to detect the second pilot pressure lb(t) that is the pressure of operation fluid passed through the second traveling fluid line 45*b*, the third pressure detector 48*c* configured to detect the third pilot pressure rf(t) that is the pressure of operation fluid passed through the third traveling fluid line 45*c*, the fourth pressure detector 48*d* configured to detect the fourth pilot pressure rb(t) that is the pressure of operation fluid passed through the fourth traveling fluid line 45*d*, and the controller 60 configured or programed to judge, based on the first, second, third and fourth pilot pressures lf(t), lb(t), rf(t) and rb(t), whether the traveling operation member 59 is operated in a direction corresponding to either the straight-traveling or the turning. According to this configuration, it can be easily judged whether the presently performed operation corresponds to either the straight-traveling or the turn based on the pressures of operation fluid (first pilot pressure lf(t), second pilot pressure lb(t), third pilot pressure rf(t), fourth pilot pressure rb(t)) in the traveling fluid lines 45 (the first traveling fluid line 45*a*, second traveling fluid line 45*b*, third traveling fluid line 45*c*, and fourth traveling fluid line 45*d*).

The work machine 1 includes the machine body 2, the left traveling device 5L provided on a left portion of the machine body 2, the right traveling device 5R provided on a right portion of the machine body 2, the left traveling motor 36L configured to output power to the left traveling device 5L, the right traveling motor 36R configured to output power to the right traveling device 5R, the left traveling pump 53L to supply operation fluid to the left traveling motor 36L, the left traveling pump 53L including the first pressure receiving portion 53*a* and the second pressure receiving portion 53*b* so that the operation fluid is used to apply a pressure to at least one of the first and second pressure receiving portions 53*a* and 53*b*, the right traveling pump 53R to supply operation fluid to the right traveling motor 36R, the right traveling pump 53R including the third pressure receiving portion 53*a* and the fourth pressure receiving portion 53*b* so that the operation fluid is used to apply a pressure to at least one of the third and fourth pressure receiving portions 53*a* and 53*b*, the traveling operation device 54 including the traveling operation member 59 and configured to apply the pressure of operation fluid to at least one of the first, second, third and fourth pressure receiving portions 53*a*, 53*b*, 53*c* and 53*d* according to operation of the traveling operation member 59, the first traveling fluid line 45*a* connected to the first pressure receiving portion 53*a*, the operation fluid having the pressure applied to the first pressure receiving portion 53*a* being passed through the first traveling fluid line 45*a* according to operation of the traveling operation member 59, the second traveling fluid line 45*b* connected to the second pressure receiving portion 53*b*, the operation fluid having the pressure applied to the second pressure receiving portion 53*b* being passed through the second traveling fluid line 45*b* according to operation of the traveling operation member 59, the third traveling fluid line 45*c* connected to the third pressure receiving portion 53*a*, the operation fluid having the pressure applied to the third pressure receiving portion 53*a* being passed through the third traveling fluid line 45*c* according to operation of the traveling operation member 59, the fourth traveling fluid line 45*d* connected to the fourth pressure receiving portion 53*b*, the operation fluid having the pressure applied to the fourth pressure receiving portion 53*b* being passed through the fourth traveling fluid line 45*d* according to operation of the traveling operation member 59, the first pressure detector 48*a* configured to detect the first pilot pressure that is the pressure of operation fluid passed through the first traveling fluid line 45*a*, the second pressure detector 48*b* configured to detect the second pilot pressure that is the pressure of operation fluid passed through the second traveling fluid line 45*b*, the third pressure detector 48*c* configured to detect the third pilot pressure that is the pressure of operation fluid passed through the third traveling fluid line 45*c*, the fourth pressure detector 48*d* configured to detect the fourth pilot pressure that is the pressure of operation fluid passed through the fourth traveling fluid line 45*d*, and the controller 60 configured or programed to judge, based on the first, second, third and fourth pilot pressures lf(t), lb(t), rf(t) and rb(t), whether the traveling operation member 59 is operated in a direction corresponding to either the spin-turn or the pivotal-turn. According to this configuration, it can be easily judged whether the presently performed operation corresponds to either the spin-turn or the pivotal-turn based on the pressures of operation fluid (first pilot pressure lf(t), second pilot pressure lb(t), third pilot pressure rf(t), fourth pilot pressure rb(t)) in the traveling fluid lines 45 (the first traveling fluid line 45*a*, second traveling fluid line 45*b*, third traveling fluid line 45*c*, and fourth traveling fluid line 45*d*).

The controller 60 judges, based on the first pilot pressure lf(t) and the fourth pilot pressure rb(t), whether the traveling operating member 59 is operated in a direction corresponding to either the spin-turn or the pivotal-turn. According to this configuration, it can be easily judged whether the presently performed operation corresponds to either the spin-turn or the pivotal-turn.

The controller 60 judges, based on the second pilot pressure lb(t) and the third pilot pressure rf(t), whether the traveling operating member 59 is operated in a direction corresponding to either the spin-turn or the pivotal-turn. According to this configuration, it can be easily judged whether the presently performed operation corresponds to either the spin-turn or the pivotal-turn.

The controller 60 judges, based on the first pilot pressure lf(t) and the third pilot pressure rf(t), whether the traveling operating member 59 is operated in a direction corresponding to either the straight-traveling or the pivotal-turn. According to this configuration, it can be easily judged whether the presently performed operation corresponds to either the straight-traveling or the pivotal-turn.

The controller 60 judges, based on the second pilot pressure lb(t) and the fourth pilot pressure rb(t), whether the traveling operating member 59 is operated in a direction corresponding to either the straight-traveling or the pivotal-turn. According to this configuration, it can be easily judged whether the presently performed operation corresponds to either the straight-traveling or the pivotal-turn. This control is a modified example of the mathematical formulas (1) and (2) in (Expression 1).

The work machine 1 includes the machine body 2, the left traveling device 5L provided on a left portion of the machine body 2, the right traveling device 5R provided on a right portion of the machine body 2, the left traveling motor 36L configured to output power to the left traveling device 5L, the right traveling motor 36R configured to output power to the right traveling device 5R, the left traveling pump 53L to supply operation fluid to the left traveling motor 36L, the left traveling pump 53L including the first pressure receiving portion 53*a* and the second pressure receiving portion 53*b* so that the operation fluid is used to apply a pressure to at least one of the first and second pressure receiving portions 53*a* and 53*b*, the right traveling pump 53R to supply operation fluid to the right traveling motor 36R, the right traveling pump 53R including the third pressure receiving portion 53*a* and the fourth pressure receiving portion 53*b* so that the operation fluid is used to apply a pressure to at least one of the third and fourth pressure receiving portions 53*a* and 53*b*, the traveling operation device 54 including the traveling operation member 59 and configured to apply the pressure of operation fluid to at least one of the first, second, third and fourth pressure receiving portions 53*a*, 53*b*, 53*c* and 53*d* according to operation of the traveling operation member 59, the first traveling fluid line 45*a* connected to the first pressure receiving portion 53*a*, the operation fluid having the pressure applied to the first pressure receiving portion 53*a* being passed through the first traveling fluid line 45*a* according to operation of the traveling operation member 59, the second traveling fluid line 45*b* connected to the second pressure receiving portion 53*b*, the operation fluid having the pressure applied to the second pressure receiving portion 53*b* being passed through the second traveling fluid line 45*b* according to operation of the traveling operation member 59, the third traveling fluid line 45*c* connected to the third pressure receiving portion 53*a*, the operation fluid having the pressure applied to the third pressure receiving portion 53*a* being passed through the third traveling fluid line 45*c* according to operation of the traveling operation member 59, the fourth traveling fluid line 45*d* connected to the fourth pressure receiving portion 53*b*, the operation fluid having the pressure applied to the fourth pressure receiving portion 53*b* being passed through the fourth traveling fluid line 45*d* according to operation of the traveling operation member 59, the first pressure detector 48*a* configured to detect the first pilot pressure lf(t) that is the pressure of operation fluid passed through the first traveling fluid line 45*a*, the second pressure detector 48*b* configured to detect the second pilot pressure lb(t) that is the pressure of operation fluid passed through the second traveling fluid line 45*b*, the third pressure detector 48*c* configured to detect the third pilot pressure rf(t) that is the pressure of operation fluid passed through the third traveling fluid line 45*c*, the fourth pressure detector 48*d* configured to detect the fourth pilot pressure rb(t) that is the pressure of operation fluid passed through the fourth traveling fluid line 45*d*, and the controller 60 configured or programed to judge, based on the first, second, third and fourth pilot pressures lf(t), lb(t), rf(t) and rb(t), whether the traveling operation member 59 is operated in the direction corresponding to the spin-turn. According to this configuration, it can be easily determined that the presently performed operation corresponds to the spin-turn based on the pressures of operation fluid (first pilot pressure lf(t), second pilot pressure lb(t), third pilot pressure rf(t), fourth pilot pressure rb(t)) in the traveling fluid lines 45 (the first traveling fluid line 45*a*, second traveling fluid line 45*b*, third traveling fluid line 45*c*, and fourth traveling fluid line 45*d*).

The work machine 1 includes the machine body 2, the left traveling device 5L provided on a left portion of the machine body 2, the right traveling device 5R provided on a right portion of the machine body 2, the left traveling motor 36L configured to output power to the left traveling device 5L, the right traveling motor 36R configured to output power to the right traveling device 5R, the left traveling pump 53L to supply operation fluid to the left traveling motor 36L, the left traveling pump 53L including the first pressure receiving portion 53*a* and the second pressure receiving portion 53*b* so that the operation fluid is used to apply a pressure to at least one of the first and second pressure receiving portions 53*a* and 53*b*, the right traveling pump 53R to supply operation fluid to the right traveling motor 36R, the right traveling pump 53R including the third pressure receiving portion 53*a* and the fourth pressure receiving portion 53*b* so that the operation fluid is used to apply a pressure to at least one of the third and fourth pressure receiving portions 53*a* and 53*b*, the traveling operation device 54 including the traveling operation member 59 and configured to apply the pressure of operation fluid to at least one of the first, second, third and fourth pressure receiving portions 53*a*, 53*b*, 53*c* and 53*d* according to operation of the traveling operation member 59, the first traveling fluid line 45*a* connected to the first pressure receiving portion 53*a*, the operation fluid having the pressure applied to the first pressure receiving portion 53*a* being passed through the first traveling fluid line 45*a* according to operation of the traveling operation member 59, the second traveling fluid line 45*b* connected to the second pressure receiving portion 53*b*, the operation fluid having the pressure applied to the second pressure receiving portion 53*b* being passed through the second traveling fluid line 45*b* according to operation of the traveling operation member 59, the third traveling fluid line 45*c* connected to the third pressure receiving portion 53*a*, the operation fluid having the pressure applied to the third pressure receiving portion 53*a* being passed through the third traveling fluid line 45*c* according to operation of the traveling operation member 59, the fourth traveling fluid line 45*d* connected to the fourth pressure receiving portion 53*b*, the operation fluid having the pressure applied to the fourth pressure receiving portion 53*b* being passed through the fourth traveling fluid line 45*d* according to operation of the traveling operation member 59, the first pressure detector 48*a* configured to detect the first pilot pressure lf(t) that is the pressure of operation fluid passed through the first traveling fluid line 45*a*, the second pressure detector 48*b* configured to detect the second pilot pressure lb(t) that is the pressure of operation fluid passed through the second traveling fluid line 45*b*, the third pressure detector 48*c* configured to detect the third pilot pressure rf(t) that is the pressure of operation fluid passed through the third traveling fluid line 45*c*, the fourth pressure detector 48*d* configured to detect the fourth pilot pressure rb(t) that is the pressure of operation fluid passed through the fourth traveling fluid line 45*d*, and the controller 60 configured or programed to judge, based on the first, second, third and fourth pilot pressures lf(t), lb(t), rf(t) and rb(t), whether the traveling operation member 59 is operated in the direction corresponding to the pivotal-turn. According to this configuration, it can be easily determined that the presently performed operation corresponds to the spin-turn based on the pressures of operation fluid (first pilot pressure lf(t), second pilot pressure lb(t), third pilot pressure rf(t), fourth pilot pressure rb(t)) in the traveling fluid lines 45 (the first traveling fluid line 45*a*, second traveling fluid line 45*b*, third traveling fluid line 45*c*, and fourth traveling fluid line 45*d*).

The work machine 1 includes the machine body 2, the left traveling device 5L provided on a left portion of the machine body 2, the right traveling device 5R provided on a right portion of the machine body 2, the left traveling motor 36L configured to output power to the left traveling device 5L, the right traveling motor 36R configured to output power to the right traveling device 5R, the left traveling pump 53L to supply operation fluid to the left traveling motor 36L, the left traveling pump 53L including the first pressure receiving portion 53*a* and the second pressure receiving portion 53*b* so that the operation fluid is used to apply a pressure to at least one of the first and second pressure receiving portions 53*a* and 53*b*, the right traveling pump 53R to supply operation fluid to the right traveling motor 36R, the right traveling pump 53R including the third pressure receiving portion 53*a* and the fourth pressure receiving portion 53*b* so that the operation fluid is used to apply a pressure to at least one of the third and fourth pressure receiving portions 53*a* and 53*b*, the traveling operation device 54 including the traveling operation member 59 and configured to apply the pressure of operation fluid to at least one of the first, second, third and fourth pressure receiving portions 53*a*, 53*b*, 53*c* and 53*d* according to operation of the traveling operation member 59, the first traveling fluid line 45*a* connected to the first pressure receiving portion 53*a*, the operation fluid having the pressure applied to the first pressure receiving portion 53*a* being passed through the first traveling fluid line 45*a* according to operation of the traveling operation member 59, the second traveling fluid line 45*b* connected to the second pressure receiving portion 53*b*, the operation fluid having the pressure applied to the second pressure receiving portion 53*b* being passed through the second traveling fluid line 45*b* according to operation of the traveling operation member 59, the third traveling fluid line 45*c* connected to the third pressure receiving portion 53*a*, the operation fluid having the pressure applied to the third pressure receiving portion 53*a* being passed through the third traveling fluid line 45*c* according to operation of the traveling operation member 59, the fourth traveling fluid line 45*d* connected to the fourth pressure receiving portion 53*b*, the operation fluid having the pressure applied to the fourth pressure receiving portion 53*b* being passed through the fourth traveling fluid line 45*d* according to operation of the traveling operation member 59, the first pressure detector 48*a* configured to detect the first pilot pressure lf(t) that is the pressure of operation fluid passed through the first traveling fluid line 45*a*, the second pressure detector 48*b* configured to detect the second pilot pressure lb(t) that is the pressure of operation fluid passed through the second traveling fluid line 45*b*, the third pressure detector 48*c* configured to detect the third pilot pressure rf(t) that is the pressure of operation fluid passed through the third traveling fluid line 45*c*, the fourth pressure detector 48*d* configured to detect the fourth pilot pressure rb(t) that is the pressure of operation fluid passed through the fourth traveling fluid line 45*d*, and the controller 60 configured or programed to judge, based on the first, second, third and fourth pilot pressures lf(t), lb(t), rf(t) and rb(t), whether the traveling operation member 59 is operated in a direction corresponding to any one of the spin-turn, the pivotal-turn, and the straight-traveling.

In the above-described second to fourth embodiments, since the second speed need only be faster than the first speed, the working machine 1 does not limit the shifting steps to two steps, and can employ the multiple shifting steps (multiple steps) more than two steps.

In the above-described embodiment, the left traveling motor 36L and the right traveling motor 36R are configured to shift their speed stage to the first speed or the second speed simultaneously, and the automatic deceleration is also performed simultaneously for the left traveling motor 36L and the right traveling motor 36R. However, the automatic deceleration may be performed while at least one of the left traveling motor 36L and the right traveling motor 36R is configured to switch to the first speed and the second speed and at least one of the left traveling motor 36L and the right traveling motor 36R is at the second speed.

In addition, the traveling motors (the left traveling motor 36L and the right traveling motor 36R) may be axial piston motors or radial piston motors. Regardless of whether the traveling motor is the radial piston motor or the radial piston motor, the motor can switch to the first speed by increasing the motor capacity, and can switch to the second speed by decreasing the motor capacity.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine comprising:

a machine body;

a left traveling device provided on a left portion of the machine body;

a right traveling device provided on a right portion of the machine body;

a left traveling motor configured to output power to the left traveling device;

a right traveling motor configured to output power to the right traveling device;

a left traveling pump to supply operation fluid to the left traveling motor, the left traveling pump including a first pressure receiving portion and a second pressure receiving portion so that the operation fluid is used to apply a pressure to at least one of the first and second pressure receiving portions;

a right traveling pump to supply operation fluid to the right traveling motor, the right traveling pump including a third pressure receiving portion and a fourth pressure receiving portion so that the operation fluid is used to apply a pressure to at least one of the third and fourth pressure receiving portions;

a traveling operation device including a traveling operation member and configured to apply the pressure of operation fluid to at least one of the first, second, third and fourth pressure receiving portions according to operation of the traveling operation member;

a first traveling fluid line connected to the first pressure receiving portion, the operation fluid having the pressure applied to the first pressure receiving portion being passed through the first traveling fluid line according to operation of the traveling operation member;

a second traveling fluid line connected to the second pressure receiving portion, the operation fluid having the pressure applied to the second pressure receiving portion being passed through the second traveling fluid line according to operation of the traveling operation member;

a third traveling fluid line connected to the third pressure receiving portion, the operation fluid having the pressure applied to the third pressure receiving portion being passed through the third traveling fluid line according to operation of the traveling operation member;

a fourth traveling fluid line connected to the fourth pressure receiving portion, the operation fluid having the pressure applied to the fourth pressure receiving portion being passed through the fourth traveling fluid line according to operation of the traveling operation member;

a first pressure detector configured to detect a first pilot pressure that is the pressure of operation fluid passed through the first traveling fluid line;

a second pressure detector configured to detect a second pilot pressure that is the pressure of operation fluid passed through the second traveling fluid line;

a third pressure detector configured to detect a third pilot pressure that is the pressure of operation fluid passed through the third traveling fluid line;

a fourth pressure detector configured to detect a fourth pilot pressure that is the pressure of operation fluid passed through the fourth traveling fluid line; and a controller configured or programed to judge, based on the first, second, third and fourth pilot pressures, whether the traveling operation member is operated in a direction corresponding to any of spin-turn, pivotal-turn and straight-traveling.

2. The working machine according to claim 1, wherein the controller is configured or programmed to judge whether the traveling operation member is operated in the direction corresponding to either the spin-turn or the pivotal-turn or not when a first ratio between the second pilot pressure and the third pilot pressure is within a predetermined range or when a second ratio between the first pilot pressure and the fourth pilot pressure is within a predetermined ratio.

3. The working machine according to claim 2, wherein the controller is configured or programmed to judge whether the traveling operation member is operated in a direction corresponding to either the spin-turn or the pivotal-turn or not based on a first judgment value that is a larger one of the first and fourth pilot pressures and a second judgment value that is a larger one of the second and third pilot pressures.

4. The working machine according to claim 3, wherein the controller is configured or programmed to consider the traveling operation member as being operated in the direction corresponding to the spin-turn when the first judgment value is less than a first average value corresponding to an average of the second and third pilot pressures or when the second judgment value is less than a second average value corresponding to an average of the first and fourth pilot pressures, and to consider the traveling operation member as being operated in the direction corresponding to the pivotal-turn when the first judgment value is not less than the first average value or when the second judgment value is not less than the second average value.

5. The working machine according to claim 1, wherein the controller is configured or programmed:

to judge whether a third ratio between the first pilot pressure and the third pilot pressure is within a predetermined range or not and whether a fourth ratio between the second pilot pressure and the fourth pilot pressure is within a predetermined range or not;

to define a larger one of the second pilot pressure and the fourth pilot pressure as a first straight traveling value when the third ratio is within the predetermined range;

to define a larger one of the first pilot pressure and the third pilot pressure as a second straight traveling value when the fourth ratio is within the predetermined range;

to calculate a straight traveling degree based on a third average value corresponding to an average of the first and third pilot pressures and on the first straight traveling value;

to calculate a straight traveling degree based on a fourth average value corresponding to an average of the second and fourth pilot pressures and on the second straight traveling value; and to judge whether the traveling operation member is operated in the direction corresponding to the straight-traveling or not based on the calculated straight traveling degree.

6. The working machine according to claim 1, wherein the controller is configured or programmed:

to judge whether a first ratio between the second pilot pressure and the third pilot pressure is within a predetermined range or not and whether a second ratio between the first pilot pressure and the fourth pilot pressure is within a predetermined range or not;

to define a larger one of the first pilot pressure and the fourth pilot pressure as a first judgment value when the first ratio is within the predetermined range;

to define a larger one of the second pilot pressure and the third pilot pressure as a second judgment value when the second ratio is within the predetermined range;

to calculate a left turning degree based on a first average value corresponding to an average of the second and third pilot pressures and on the first judgment value;

to calculate a right turning degree based on a second average value corresponding to an average of the first and fourth pilot pressures and on the second judgment value; and to judge whether the traveling operation member is operated for left turning of the working machine in the direction corresponding to the spin-turn or the pivotal-turn based on the calculated left turning degree; and to judge whether the traveling operation member is operated for right turning of the working machine in the direction corresponding to the spin-turn or the pivotal-turn based on the calculated right turning degree.

7. The working machine according to claim 1, wherein the controller is configured or programmed to consider the traveling operation member as being operated in the direction corresponding to the spin-turn when either one of a first differential pressure acquired by subtracting the second pilot pressure from the first pilot pressure and a second differential pressure acquired by subtracting the fourth pilot pressure from the third pilot pressure is a positive number and the other is a negative number.

8. The working machine according to claim 1, wherein the controller is configured or programmed to consider the traveling operation member as being operated in a direction corresponding to a small turn of the working machine along a middle turning circle when the first pilot pressure is not less than a first threshold and a second differential pressure acquired by subtracting the fourth pilot pressure from the third pilot pressure is not more than a second threshold or when the third pilot pressure is not less than a third threshold and a first differential pressure acquired by subtracting the second pilot pressure from the first pilot pressure is not more than a fourth threshold.

9. The working machine according to claim 1, wherein the controller is configured or programmed to consider the traveling operation member as being operated in a direction corresponding to a small turn of the working machine along a middle turning circle when the first pilot pressure is not less than a first threshold and the third pilot pressure is not more than a fifth threshold or when the third pilot pressure is not less than a third threshold and the first pilot pressure is not more than a sixth threshold.

10. The working machine according to claim 1, wherein the controller is configured or programmed to consider the traveling operation member as being operated in a direction corresponding to a large turn of the working machine along a large turning circle that is radially larger than a middle turning circle for a small turn of the working machine when the first pilot pressure is not less than a seventh threshold and a second differential pressure acquired by subtracting the fourth pilot pressure from the third pilot pressure is not less than an eighth threshold or when the third pilot pressure is not less than a ninth threshold and a first differential pressure acquired by subtracting the second pilot pressure from the first pilot pressure is not less than a tenth threshold.

11. The working machine according to claim 1, wherein the controller is configured or programmed to consider the traveling operation member as being operated in a direction corresponding to a large turn of the working machine along a large turning circle that is radially larger than a middle turning circle for a small turn of the working machine when the first pilot pressure is not less than a seventh threshold and the third pilot pressure is not more than the seventh threshold and is not less than an eleventh threshold or when the third pilot pressure is not less than a ninth threshold and the first pilot pressure is not more than the ninth threshold and not less than a twelfth threshold.

12. The working machine according to claim 1, wherein a plurality of values are each provided as the second threshold, and a plurality of values are each provided as the fourth threshold.

13. The working machine according to claim 1, wherein a plurality of values are each provided as the eighth threshold, and a plurality of values are each provided as the tenth threshold.

14. The working machine according to claim 1, wherein the left traveling motor is rotated at a speed shiftable between a first speed and a second speed faster than the first speed, the right traveling motor is rotated at a speed shiftable between a first speed and a second speed faster than the first speed, and the controller is configured or programmed:

to perform automatic deceleration to automatically reduce rotation speeds of the left and right traveling motors by shifting from the second speed to the first speed;

to perform automatic speed-restoration to automatically restore the rotation speeds of the left and right traveling motors before performing the automatic deceleration by shifting from the first speed to the second speed; and to judge whether to perform the automatic deceleration and whether to perform the automatic speed-restoration based on which direction the traveling operation member is considered as being operated in.

15. The working machine according to claim 14, wherein the controller is configured or programmed:

to consider the traveling operation member as being at a neutral position when the first to fourth pilot pressures are each not more than a predetermined value; and to perform the automatic speed-restoration when the automatic deceleration is performed and all the first to fourth pilot pressures are each detected as being not more than the predetermined value.

16. The working machine according to claim 1, further comprising:

an actuation valve to control a pressure of the operation fluid supplied to the traveling operation device, wherein the controller is configured or programmed to change control of the actuation valve based on which direction the traveling operation member is considered as being operated in.

* * * * *